US011634967B2

(12) United States Patent
Kunz

(10) Patent No.: US 11,634,967 B2
(45) Date of Patent: Apr. 25, 2023

(54) METHOD FOR WELL REMEDIATION AND REPAIR

(71) Applicant: WINTERHAWK WELL ABANDONMENT LTD., Calgary (CA)

(72) Inventor: Dale Kunz, Calgary (CA)

(73) Assignee: WINTERHAWK WELL ABANDONMENT LTD., Calgary (CA)

( * ) Notice: Subject to any disclaimer, the term of this patent is extended or adjusted under 35 U.S.C. 154(b) by 18 days.

(21) Appl. No.: 17/334,975

(22) Filed: May 31, 2021

(65) Prior Publication Data

US 2022/0381110 A1 Dec. 1, 2022

(51) Int. Cl.
*E21B 33/16* (2006.01)
*E21B 33/129* (2006.01)

(52) U.S. Cl.
CPC ..... *E21B 33/16* (2013.01); *E21B 33/1292* (2013.01)

(58) Field of Classification Search
CPC ..... E21B 33/1292; E21B 33/16
See application file for complete search history.

(56) References Cited

U.S. PATENT DOCUMENTS 2,119,252 A 5/1938 Thaheld
3,068,942 A 12/1962 Brown
3,464,709 A 9/1969 Furgason et al.
3,561,527 A 2/1971 Nelson
4,069,573 A 1/1978 Rogers, Jr. et al.
(Continued)

FOREIGN PATENT DOCUMENTS

CA 2487286 A1 12/2003
CA 2759158 A1 8/2007
(Continued)

OTHER PUBLICATIONS

Byram, T.G. Casing and Liners for Drilling and Completion. Design and Application. Gulf Drilling Guides. Second Edition. Sections 6.9.1-6.9.4 and p. 201.

(Continued)

*Primary Examiner* — Cathleen R Hutchins
*Assistant Examiner* — Ronald R Runyan
(74) *Attorney, Agent, or Firm* — Parlee McLaws LLP

(57) ABSTRACT

Methods for more reliably cementing and remediating oil and gas wells by plastically expanding the diameter of the wellbore casing at select locations along the wellbore to control fluid flow in the micro-annular leak paths formed in the casing annulus between the casing and cement sheath, or between the casing and wellbore. Such methods do not require pre-placement of casing packers or prediction of potential leak points of the casing annulus. In cementing operations, casing expansion can be performed at strategic locations along the wellbore to eliminate annular leak paths that permit detrimental flow, direct the flow of cement to the desired portions of the wellbore, and prevent the flow of cement to oil producing formations. In instances of inter-zonal communication between subterranean formations, casing expansion can be performed at location(s) between the formations to mitigate or prevent inter-zonal communication via annular leak paths in the casing annulus.

19 Claims, 22 Drawing Sheets

(56) References Cited

U.S. PATENT DOCUMENTS

| | | | | |
|---|---|---|---|---|
| 4,116,451 | A | 9/1978 | Nixon et al. | |
| 4,127,168 | A | 11/1978 | Hanson et al. | |
| 4,444,400 | A | 4/1984 | Norman | |
| 4,483,399 | A | 11/1984 | Colgate | |
| 4,688,640 | A | 8/1987 | Pritchard | |
| 4,716,965 | A | 1/1988 | Bol et al. | |
| 5,124,254 | A | 6/1992 | Copple et al. | |
| 5,127,473 | A * | 7/1992 | Harris | C09K 8/428 166/292 |
| 6,581,682 | B1 | 6/2003 | Parent et al. | |
| 6,622,797 | B2 | 9/2003 | Sivley, IV | |
| 6,725,917 | B2 * | 4/2004 | Metcalfe | E21B 43/106 166/207 |
| 7,000,704 | B2 | 2/2006 | Smith | |
| 7,168,497 | B2 | 1/2007 | Metcalfe | |
| 7,367,391 | B1 | 5/2008 | Stuart et al. | |
| 7,506,687 | B2 | 3/2009 | Ring | |
| 7,703,542 | B2 | 4/2010 | O'Connor et al. | |
| 8,453,729 | B2 | 6/2013 | Harris et al. | |
| 9,303,477 | B2 | 4/2016 | Harris et al. | |
| 9,752,408 | B2 | 9/2017 | Robben | |
| 10,794,158 | B2 | 10/2020 | Cornelissen | |
| 2001/0045284 | A1 | 11/2001 | Simpson et al. | |
| 2002/0121372 | A1 * | 9/2002 | Cook | E21B 43/108 166/250.15 |
| 2005/0056433 | A1 * | 3/2005 | Ring | E21B 43/105 166/207 |
| 2005/0217865 | A1 * | 10/2005 | Ring | E21B 43/105 166/207 |
| 2007/0095532 | A1 | 5/2007 | Head et al. | |
| 2008/0105431 | A1 * | 5/2008 | Baaijens | E21B 29/00 166/297 |
| 2008/0142213 | A1 | 6/2008 | Costa et al. | |
| 2008/0223568 | A1 | 9/2008 | Roggebond et al. | |
| 2009/0321084 | A1 * | 12/2009 | Simmons | F04B 15/00 166/372 |
| 2010/0019426 | A1 | 1/2010 | Kunz | |
| 2010/0122820 | A1 | 5/2010 | Holland | |
| 2010/0319427 | A1 | 12/2010 | Lohbek | |
| 2012/0097391 | A1 | 4/2012 | Whiddon | |
| 2015/0285026 | A1 | 10/2015 | Frazier | |
| 2017/0145782 | A1 | 5/2017 | Ferg | |
| 2018/0163490 | A1 | 6/2018 | Styler | |
| 2019/0169951 | A1 | 6/2019 | Frazier | |
| 2019/0352987 | A1 | 11/2019 | Hrupp | |

FOREIGN PATENT DOCUMENTS

| | | | |
|---|---|---|---|
| CA | 2842406 | C | 8/2015 |
| CA | 2913933 | A1 | 6/2017 |
| CN | 2433389 | Y | 6/2001 |
| CN | 103184866 | A | 7/2013 |
| EP | 2599955 | A1 | 6/2013 |
| NO | 2018083069 | A1 | 5/2018 |
| WO | 20170091911 | A1 | 12/2016 |
| WO | 20170197517 | A1 | 11/2017 |

OTHER PUBLICATIONS

Hill et al. Large Elastic Compression of Finite Rectangular Blocks of Rubber. Q. JI Mech. Appl. Math 42(2), pp. 267-287. Oxford University Press, 1989.

Jackson, R.E. Gas Release Mechanisms from Energy Wellbores. ARMA 14-7753. 48th US Rock Mechanics / Geomechanics Symposium. Minneapolis, MN, USA, Jun. 1-4, 2014.

Khandka, R.K. Leakage Behind Casing. TPG 4920 Drilling Specialization Thesis Work. NTNU, Jun. 11, 2007.

Kupresan, D. et al. Experimental Assessment of Casing Expansion as a Solution to Microannular Gas Migration. IADC/SPE SPE-168056-MS. 2014 IADC/SPE Drilling Conference and Exhibition. Fort Worth, Texas, USA, Mar. 4-6, 2014.

Lakes, R. Compression of a block. http://silver.neep.wisc.edu/~lakes/EMA611block.html. May 27, 2018.

Pinarbasi, S. et al. Compression of solid and annular circular discs bonded to rigid surfaces. International Journal of Solids and Structures 45 (2008) 4543-4561.

Sridharan, K. Deformation Analysis of Rubber Blocks Under Large Compressive Strain. JCHPS Special Issue 9: Apr. 2015, pp. 130-136.

Technology Subgroup of the Operations & Environment Task Group. Paper #2-25. Plugging and Abandonment of Oil and Gas Wells. Working Document of the NPC North American Resource Development Study Made Available Sep. 15, 2011, pp. 1-21.

Yeoh, O.H. The Compression Modulus of Tall Rubber Cylinders. J. Rubb. Res, Inst. Malaysia, 33(3), 109-114, 1985.

Yuanhua, L. et al. An experimental study on reshaping C110 deformed casing with spinning casing swage. Natural Gas Industry B (2015) 257-262.

George E. King Engineering. Plug and Abandonment—Producing Well. Slides. Mar. 14, 2009. GEKEngineering.com.

Global CCS Institute. 2. Well Plugging and Abandonment Techniques. 2016.

ITF. Through Tubing Logging—Plugging and Abandonment. Call for Proposals. Aug. 2015.

Alberta Energy Regulator—Directive 020. Well Abandonment. Mar. 15, 2016.

International Search Report and Written Opinion issued on International PCT Application No. PCT/CA2018/050661 dated Feb. 19, 2019.

Extended European Search Report on European Patent Application No. 18920425.8 dated Dec. 3, 2021.

Written Opinion issued on Singapore Patent Application No. 11202011981S dated Feb. 16, 2022.

Machine English Translation of Chinese Patent Application No. 2433389, having a publication date of Jun. 6, 2001.

Machine English Translation of Chinese Patent Application No. 103184866, having a publication date of Jul. 3, 2013.

Final Office Action issued on U.S. Appl. No. 15/734,171 dated Sep. 15, 2022.

* cited by examiner

METHOD FOR WELL REMEDIATION AND REPAIR

FIELD

Embodiments herein relate generally to completion, maintenance, and remediation of oil and gas wells. In particular, embodiments herein relate to an improved method and system for wellbore cementing operations and mitigating undesirable communication between subterranean formations.

BACKGROUND

Oil and gas wells are drilled into subterranean hydrocarbon-bearing formations for extraction of hydrocarbons therefrom. Wellbores are drilled through or into the hydrocarbon formation and often lined or "cased" with a tubular steel casing for at least a portion of the length of the wellbore. Wellbores are typically 38.1 mm (1.5") larger in diameter than the outside diameter of the casing, defining an annular space therebetween. When the well is completed, this annular space, or casing annulus, is often filled with cement, which seals the casing annulus to prevent hydrocarbon communication to the surface therethrough. While operators seek to ensure that the cement seal is complete and uniform, the integrity and/or durability of the seal can be affected by variances in the characteristics of the geological formations through which the wellbore passes.

Over time, the cement and the surrounding geology characteristics of the wellbore change as hydrocarbons are produced from the reservoir. The cement shrinks, creating micro-annular spaces between the outside diameter of the steel casing and the inside diameter of the cement sheath. Thus, the cement seal may have been incomplete for the reasons discussed above. This can allow communication between the production zone and the surface, and/or between different zones in the reservoir. Both conditions are undesirable. This problem is exacerbated by the repeated elastic expansion and contraction of the casing by production practices.

Traditionally, oil and gas well operators have used a method of perforating the steel casing and injecting additional cement or some other sealant into the annular space to "fill" the problematic micro-annular leak paths. This is commonly referred to as a "cement squeeze". This method only successfully remediates the problem less than 50% of the time.

When a cement squeeze operation is performed, the operator has no way of determining from surface where the cement will flow once it has passed through the perforations formed in the casing. Being fluid, the cement slurry will follow the path of least resistance, which is not always the annular leak pathway to be repaired. For example, in the event of a gas leak along the annular leak path, gas is much less viscous than liquid, and will pass through void spaces that will not allow the passage of cement slurry. To increase the chances of the cement reaching the annular leak path, operators turn to increasing the pressure and volumes of cement pumped downhole and through larger perforation areas. In some cases, the steel well casing is milled entirely away to gain access to the entirety of the casing annulus.

Performing cement squeezes near hydrocarbon producing zone(s) may also result in cement entering the producing zone(s), thus impairing production and negatively affecting the commercial value of the well.

More recently, wells have been completed with an "external casing packer" which is designed to enhance the seal between the casing and wellbore using a mechanical means or plug that serves to further block flow via the micro-annular leak path formed between. Such external casing packers must be installed along the casing string in advance prior to the running in and setting of the casing in the wellbore. As it is typically not feasible to determine where leak paths will form in advance, external casing packers must be installed at one or more intervals along the casing in advance with placement selected in the areas in which the cement leakage or poor cement seal is likely to occur. This increases well completion costs.

In older wellbores, cement was not always placed to the surface in the casing annulus if there were no hydrocarbon bearing formations impacted by drilling. More recently, concern has grown regarding the contamination of ground water aquifers near wellbores that are not protected by a cement seal. In such cases, the operator may be required to place cement in the theretofore non-cemented portion of the casing annulus to protect areas above the existing cement sheath. Typically, such remedial cementing is done by perforating the casing uphole of the existing cement sheath and pumping cement into and up the casing annulus to the surface to fill the annulus with cement. As in cement squeeze operations, control of the cement flow is problematic and cement may not necessarily flow along the desired flow path, necessitating additional cement volume and flow pressure to increase the chances of the cementing operation being successful.

Wellbore remediation may also be necessary when there is inter-zonal communication between the hydrocarbon producing zone(s) of interest and another zone containing water or natural gas, as such inter-zonal communication may interfere with the production of hydrocarbons. For example, deficient cementing of the casing annulus, or deterioration of the cement sheath, can lead to communication between hydrocarbon producing and other zones. Water inflow to the production stream increases production costs. The conventional method of remediating inter-zonal communication is perforating the casing and performing cement squeeze operations therethrough, which are expensive and unreliable for the reasons discussed above.

There remains a need for a method of remediating an oil and gas well and cementing the wellbore annulus while reducing the amount of cement expended and preventing the flow of cement to hydrocarbon producing zones near the area to be cemented. There is also a need for a reliable and cost-effective method of mitigating unwanted communication between various zones of a wellbore.

SUMMARY

Methods for more reliably cementing and remediating oil and gas wells are disclosed herein, comprising controlling fluid flow in the micro-annular leak paths formed in the casing annulus between the cement sheath and casing by plastically expanding the diameter of the wellbore casing at select locations along the wellbore.

Such methods do not require pre-placement of casing packers or prediction of potential leak points of the casing annulus.

In cementing operations, casing expansion can be performed at strategic locations along the wellbore to reduce the porosity and permeability of the cement sheath thereabout, eliminating annular leak paths that permit detrimental flow, and direct the flow of cement to the desired portions of the wellbore. Further, the casing expansions can be used to prevent the flow of cement to oil producing formations. Casing expansion can also be performed at locations along the wellbore with no cement sheath to restrict or prevent flow through the casing annulus.

In instances of inter-zonal communication between subterranean formations, casing expansion can be performed at one or more locations intermediate the formations to mitigate or prevent communication therebetween via annular leak paths formed between the casing and cement sheath, or between the casing and wellbore.

In a broad aspect, a method of cementing a wellbore having a wellbore casing extending therethrough, the casing having a casing bore, comprises: conveying a casing expanding tool downhole to at least one expansion location along the casing; actuating the casing expanding tool to plastically deform the casing radially outward at the at least one expansion location; conveying a cementing string downhole through the casing bore to position one or more cement outlets of the cementing string proximate a target interval having one or more perforations formed through the casing; and introducing cement from surface downhole through the cementing string and to the outside of the casing via the one or more perforations.

In an embodiment, the method further comprises forming the one or more perforations through the casing at the target interval for establishing communication between the casing bore and an outside of the casing.

In an embodiment, the at least one expansion location is located downhole of the target interval.

In an embodiment, the at least one expansion location is located uphole of the target interval.

In an embodiment, the at least one expansion location comprises at least one uphole expansion location uphole of the cementing zone, and at least one downhole expansion location downhole of the cementing zone.

In an embodiment, the step of actuating the casing expanding tool further comprises actuating an expansion element of the casing expanding tool radially outwards and radially contracting the expansion element after the casing has been plastically deformed.

In an embodiment, the step of actuating the expansion element comprises axially compressing the expansion element to expand the expansion element radially outwards, and the step of radially contracting the expansion element comprises axially releasing the expansion element.

In an embodiment, the step of axially compressing the expansion element comprises actuating an axial actuator of the casing expanding tool to drive a second stop of the casing expanding tool toward a first stop of the casing expanding tool, and the step of axially releasing the expansion element comprises actuating the axial actuator to move the second stop away from the first stop.

In an embodiment, the step of actuating the axial actuator comprises operating an electric motor of the casing expanding tool to drive a hydraulic pump of the casing expanding tool.

In an embodiment, the step of driving the hydraulic pump comprising hydraulically driving one or more pistons relative to an outer sleeve of the axial actuator, the one or more pistons operatively connected to the second stop and the outer sleeve operatively to the first stop.

In an embodiment, one or more of the at least one expansion location is located at a portion of the casing having a cement sheath thereabout, such that plastically deforming the casing radially outward further comprises compressing the cement sheath to compact the cement.

In an embodiment, the target interval is selected to include one or more leak paths formed between a casing annulus defined between the casing and the cement sheath.

In an embodiment, the target interval is selected to include an uncemented length of the casing.

In another broad aspect, a method of mitigating communication between a first subterranean formation and a second subterranean formation of a wellbore comprises: conveying a casing expanding tool downhole on a conveyance string to at least one expansion location along the casing located intermediate the first and second subterranean formations; and actuating the casing expanding tool to plastically deform the casing radially outward at the at least one expansion location.

In an embodiment, the step of actuating the casing expanding tool further comprises actuating an expansion element of the casing expanding tool radially outwards and radially contracting the expansion element after the casing has been plastically deformed.

In an embodiment, the step of actuating the expansion element comprises axially compressing the expansion element to expand the expansion element radially outwards, and the step of radially contracting the expansion element comprises axially releasing the expansion element.

In an embodiment, the step of axially compressing the expansion element comprises actuating an axial actuator of the casing expanding tool to drive a second stop of the casing expanding tool toward a first stop of the casing expanding tool, and the step of axially releasing the expansion element comprises actuating the axial actuator to move the second stop away from the first stop.

In an embodiment, the step of actuating the axial actuator comprises operating an electric motor of the casing expanding tool to drive a hydraulic pump of the casing expanding tool.

The method of claim 18, wherein the step of driving the hydraulic pump comprising hydraulically driving one or more pistons relative to an outer sleeve of the axial actuator, the one or more pistons operatively connected to the second stop and the outer sleeve operatively to the first stop.

In an embodiment, one or more of the at least one expansion location is located at a portion of the casing having a cement sheath thereabout, such that plastically deforming the casing radially outward further comprises compressing the cement sheath to compact the cement.

BRIEF DESCRIPTION OF THE DRAWINGS

FIG. 1A depicts a perforation tool creating perforations in the wellbore casing at a target interval of the wellbore;

FIG. 1B depicts a casing expansion tool expanding the wellbore casing at locations downhole of the target interval;

FIG. 1C depicts the casing expansion tool of FIG. 1B expanding the wellbore casing at locations uphole of the target interval;

FIG. 1D depicts a cement string introducing cement into the target interval via the casing perforations;

FIG. 2A depicts a perforation tool creating perforations in the wellbore casing at a target interval comprising an uncased length of the wellbore;

FIG. 2B depicts a casing expansion tool expanding the wellbore casing at locations downhole of the target interval;

FIG. 2C depicts a cement string introducing cement into the target interval via the casing perforations;

FIG. 2D depicts a cement string introducing cement into a different target interval via casing perforations, the casing being expanded at a section of casing having no cement sheath thereabout;

FIG. 3A depicts a wellbore extending through a gas formation, oil formation, and water formation, wherein gas and water are able to flow to the oil formation via annular leak paths between the wellbore casing and wellbore;

FIG. 3B depicts a casing expansion tool expanding the wellbore casing at locations intermediate the oil formation and water formation;

FIG. 3C depicts a casing expansion tool expanding the wellbore casing at locations intermediate the oil formation and gas formation;

DESCRIPTION

With reference to FIGS. 1A-3C, embodiments of methods for remediating oil and gas wells are described herein utilizing the permanent plastic deformation of casing to increase the casing diameter at select locations along the wellbore. Such selective casing deformation has only recently been enabled by technological advances, such as the device disclosed in Applicant's PCT Patent Application No. PCT/CA2018/050661 or the device closed in Applicant's U.S. patent application Ser. No. 16/099,942, incorporated herein in their entirety.

In the context of cement squeeze operations, with reference to FIGS. 1A-1D, it is desired to introduce remedial cement to a target interval 8 of the wellbore where micro-annular leak paths have formed in the casing annulus between the casing 12 and cement sheath 14 thereabout. To reduce the amount of cement needed for the cement squeeze operation, the target interval 8 can be limited to the length of the wellbore that encompasses the zone experiencing problematic leakage.

Figure 1A:
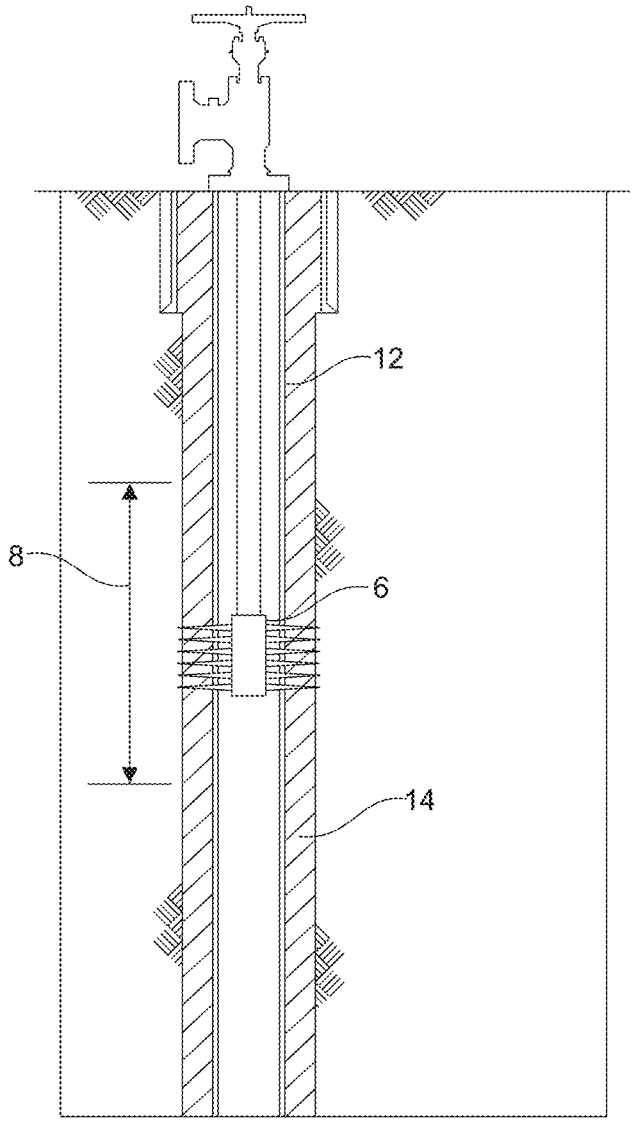
FIGS. 1A to 1D are diagrammatic representations of a wellbore cement squeeze operation utilizing casing expansion.
Figure 1B:
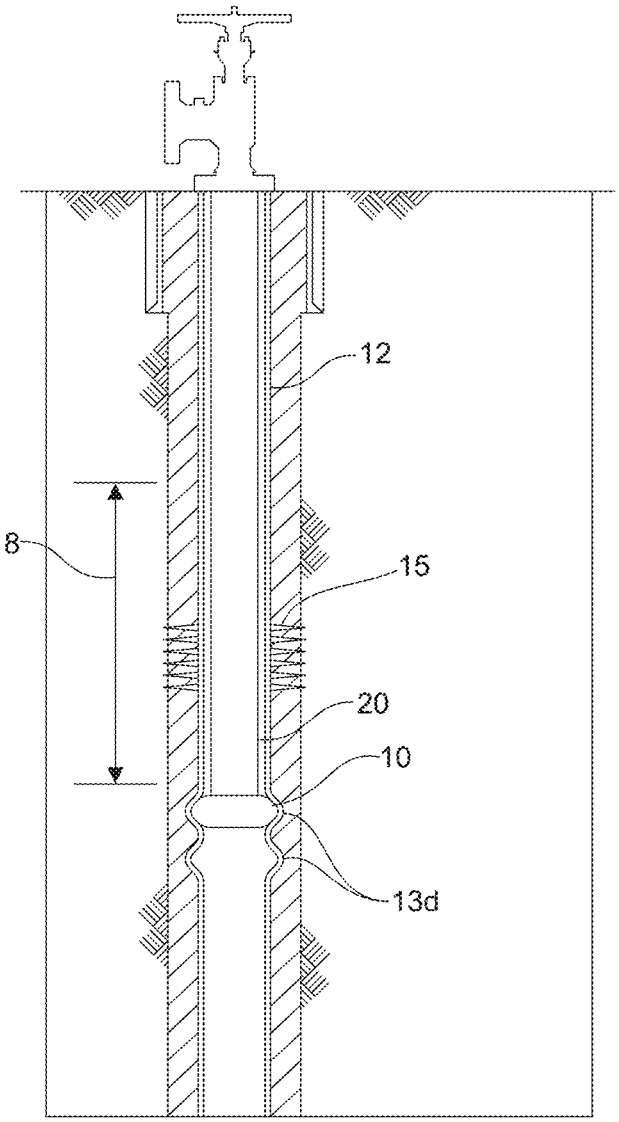

Turning to FIG. 1A, in preparation for cement squeeze operations, perforations 15 can be formed in the casing 12 at the target interval 8 using a suitable wireline or tubing-conveyed casing perforation tool 6 to establish communication between the casing bore and the outside of the casing. In other embodiments, perforations 15 may already be present in the casing 12 at the target interval 8 and the step of perforating the casing 12 is not needed. Referring to FIG. 1B, after the perforations 15 are formed, a casing expanding/setting tool 20 capable of permanently plastically deforming the casing 12 can be run therein and positioned at a downhole expansion location 13*d* downhole of the target interval 8. Once located at the downhole expansion location 13*d*, the tool 20 is actuated to plastically deform the casing 12 and expand its diameter to radially compress and compact the surrounding cement sheath 14. Such deformation of the casing 12 and compression of the sheath 14 is permanent, and acts to reduce or block fluid flow through annular leak paths of the sheath 14. In embodiments, the tool 20 can be used to expand the casing 12 multiple axial locations 13*d* downhole of the target interval 8 in the same manner.

Figure 1C:
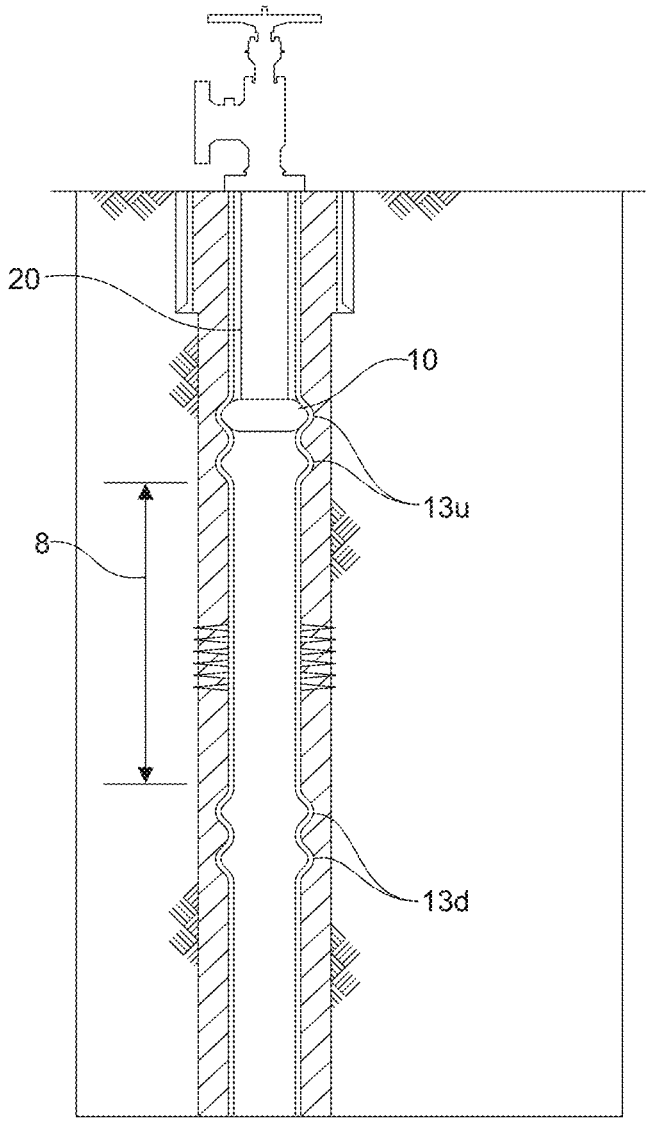

With reference to FIG. 1C, the casing expanding tool 20 can then be repositioned to an uphole expansion location 13*u* uphole of the target interval 8, and actuated to expand the diameter of the casing 12 in the manner described above so as to block fluid flow through the annular leak paths thereat. As above, in embodiments, the tool 20 can be used to expand the casing 12 at multiple axial locations 13*u* uphole of the target interval 8.

Figure 1D:
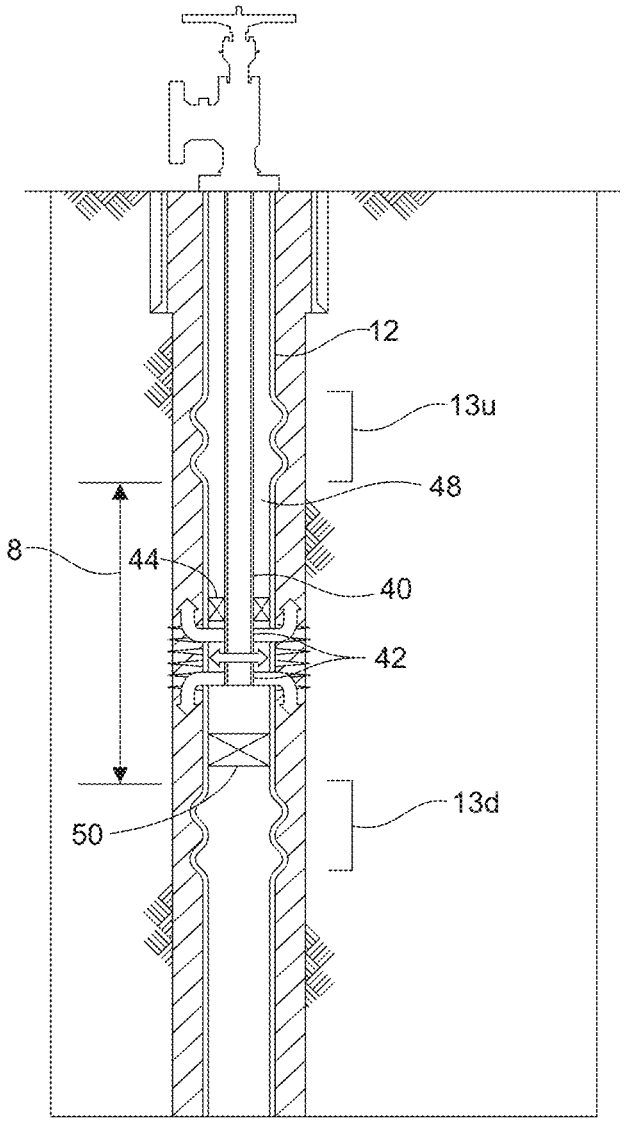

Turning to FIG. 1D, once the casing 12 has been expanded at the desired expansion locations, the casing expanding tool 20 can be retrieved to surface, and a cement string 40 can be run into the casing bore such that one or more cement outlets 42 thereof are positioned at or proximate the target interval 8. The casing bore can then be sealed off such that cement exiting the cement outlets 42 must flow out through the casing perforations 15 of the target interval 8. For example, as shown in FIG. 1D, a bridge plug 50 can be set below the cement outlets 42 prior to running in of the cementing string 40 to fluidly seal the casing bore downhole of the cement outlets 42. Further, packers 44 located above the cement outlets 42 of the cementing string 40 can be set so as to prevent fluid flow thereby in the annulus 48 formed between the cementing string 40 and inner wall of the casing 12, and fluidly seal the casing bore uphole of the cement outlets 42.

After flow in the casing bore uphole and downhole of the cement outlets 42 is blocked, cement can be introduced into the target interval 8 by pumping cement from surface downhole through the cementing string 40. Cement then flows out of the cementing string 40 through the cement outlets 42, and through the perforations 15 to the outside of the casing 12 within the target interval 8. The expanded portions of the casing 12 at the expansion locations 13 mitigate or prevent cement flow through annular leak paths formed between the casing 12 and cement sheath 14 or in the sheath 14 itself. In other words, the expanded portions act as barriers to cement flow out of the target interval 8. Such control of cement flow using casing expansions reduces the volume of cement lost via flow to undesired regions via annular leak paths, and thus the volume of cement required for the cement squeeze operation is reduced. Additionally, the casing expansions can be used to prevent cement flow to oil producing formations near the target interval 8.

While instances of casing expansion described above involve expanding casing 12 to compress and compact the cement sheath 14 thereabout, Applicant has found that expansion of portions of casing 12 not surrounded by a cement sheath 14 is still effective in restricting fluid flow along the casing annulus between the casing 12 and wellbore. In such cases, the casing expansions can extend partially into the casing annulus, or contact the wellbore to compress and compact the wellbore thereabout, to restrict or block annular leak paths thereabout.

Figure 2A:
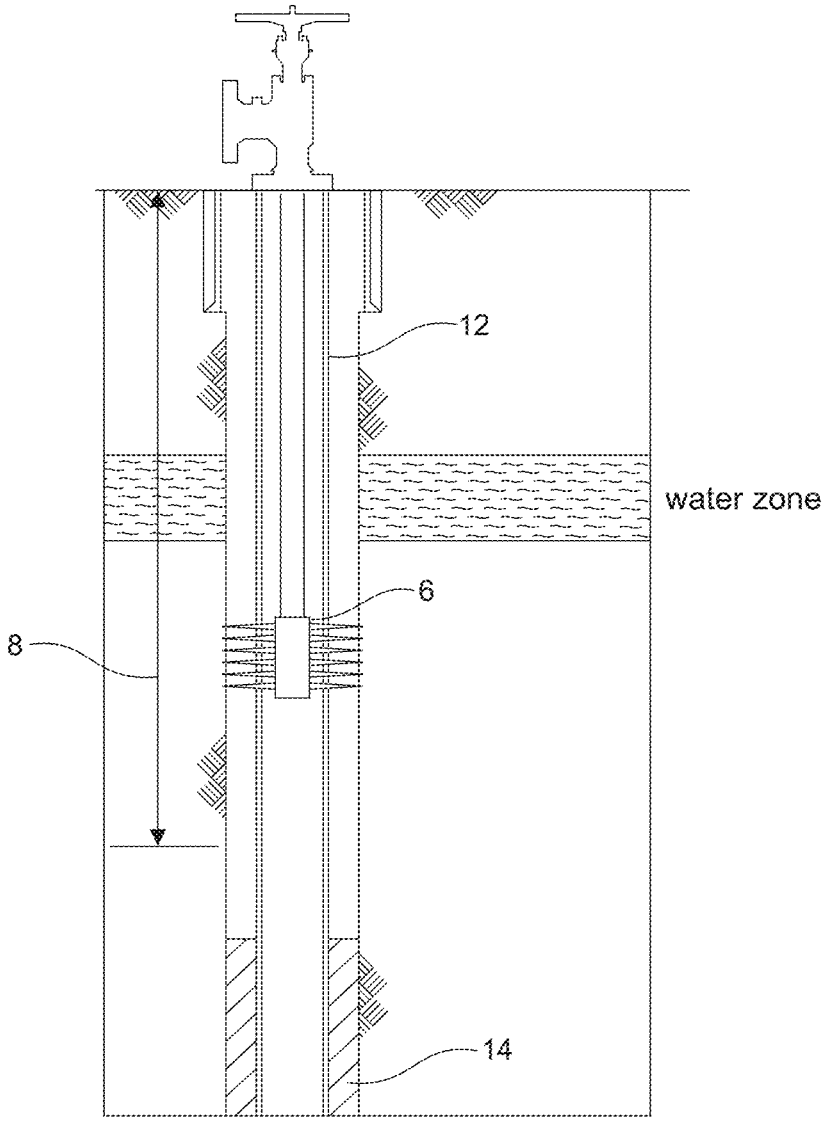
FIGS. 2A to 2D are diagrammatic representations of a remedial cementing operation utilizing casing expansion.
Figure 2B:
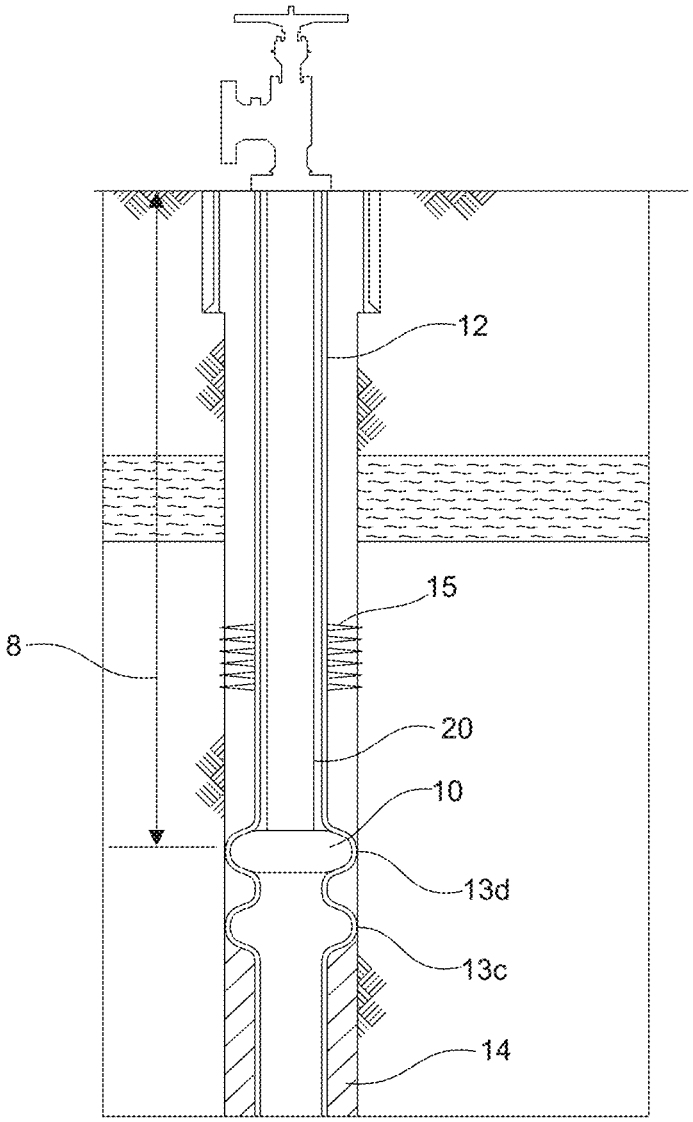
Figure 2C:
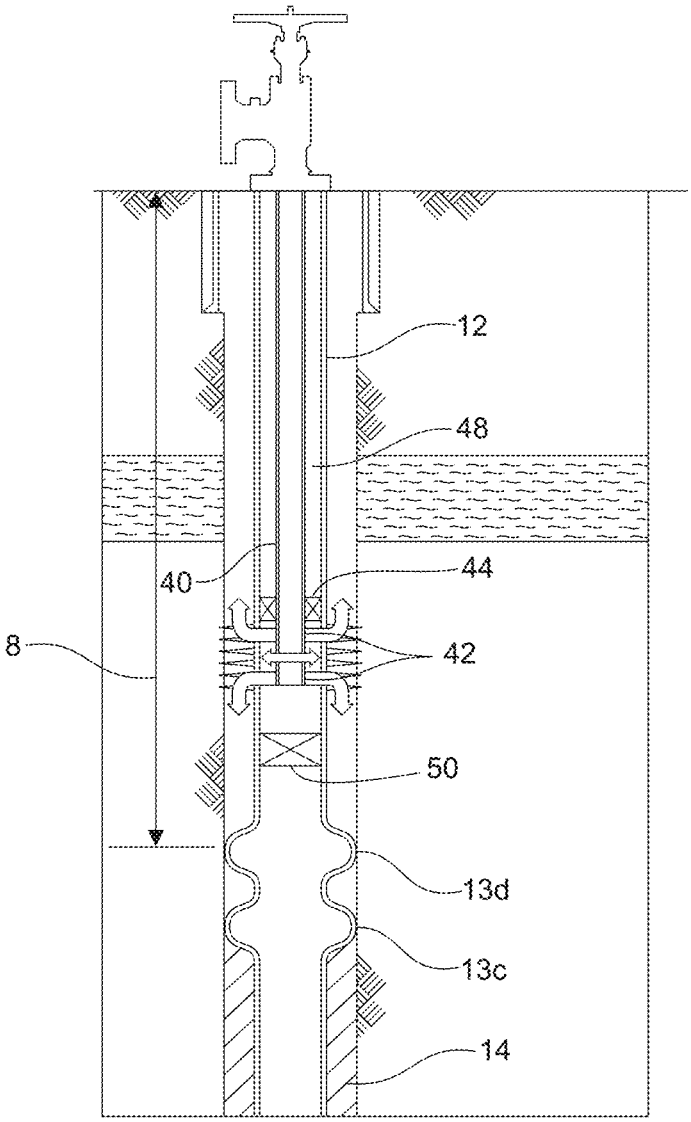
Figure 2D:
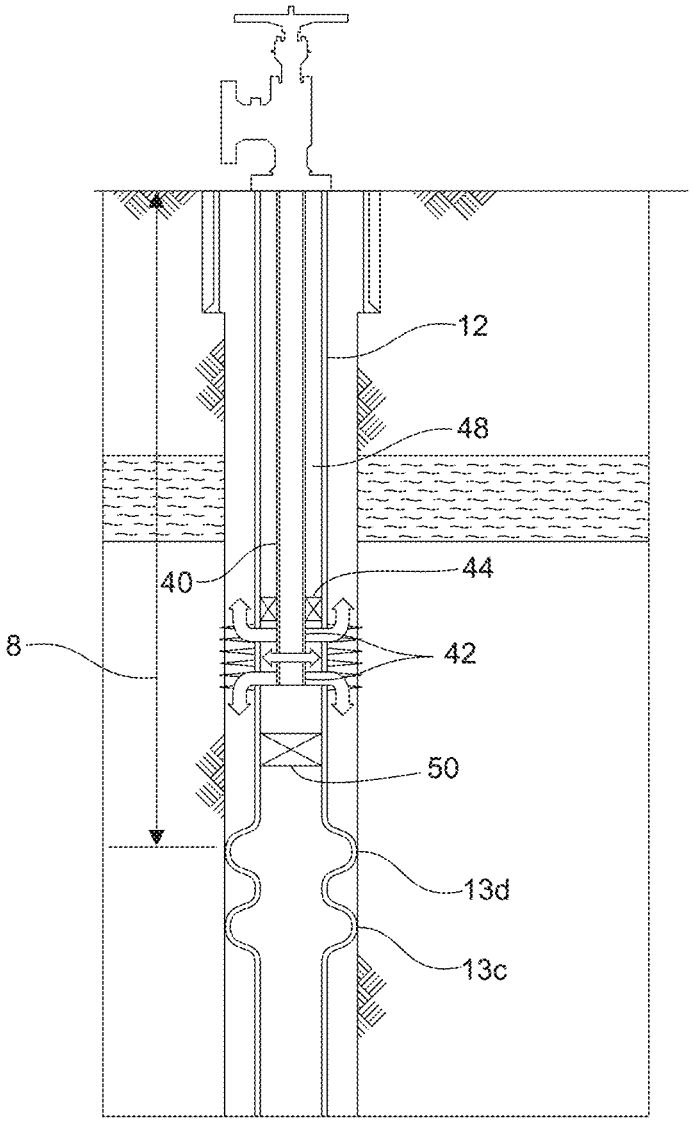

In remedial cementing operations, with reference to FIGS. 2A-2C, it is desired to introduce cement to a target interval 8 comprising a length of the wellbore lacking a cement sheath 14. To reduce the volume of cement required for such operations, the casing 12 can be permanently plastically expanded at one or more expansion locations 13 downhole of the target interval 8. As shown in FIG. 2A, in remedial cementing operations to protect a water zone at an uncemented portion of the casing 12, perforations 15 can be formed at target interval 8 comprising the uncemented portion, if not already present. Referring to FIG. 2B, the casing 12 is then expanded with the casing expanding tool 20 at one or more casing expansion locations downhole of the target interval 8, such as at a first casing expansion location 13*c* located at a portion of the wellbore having a cement sheath 14 and at a second expansion location 13*d* located at a portion of the wellbore not having a cement sheath 14. In other embodiments, the cementing operation can comprise more or fewer casing expansion locations 13 as needed, said casing expansion locations 13 located at areas having a cementing sheath 14 thereabout, not having a cement sheath 14, or a combination thereof. For example, FIG. 2D depicts an embodiment where the casing expansion locations 13 are selected to be at portions of the casing 12 having no sheath 14 thereabout, the casing 12 being radially plastically expanded to contact the wellbore. As above, with reference to FIG. 2C, once the casing 12 has been expanded at the expansion locations 13, a cementing string 40 can then be run into the casing bore and the flow through the casing bore blocked off above and below the cement outlets 42 of the cementing string 40, such as with bridge plug 50 and packers 44. Cement can then be pumped from surface downhole through the cementing string 40 to the outside of the casing 12 within the target interval 8. The casing expansions at the expansion locations 13 act as barriers to prevent cement from flowing downhole therepast, thus directing cement to the target interval 8 and away from other portions of the wellbore. By this manner of directing cement flow, the volume of cement required to remedial cementing operation is reduced and cement flow to undesirable areas, such as oil producing formations, is mitigated or prevented. While FIGS. 2A-2D depict a remedial cementing operation to protect a water zone in the target interval, the method of performing remedial cementing using casing expansions can be used in any situation wherein it is desirable to introduce cement to a previously uncement portion of the casing 12. Further, while FIGS. 2A-2D depict the casing expansion locations 13 as being downhole of the target interval 8, in some embodiments, the casing expansion locations 13 can be located uphole of the target interval 8, or both uphole and downhole of the target interval 8.

Figure 3A:
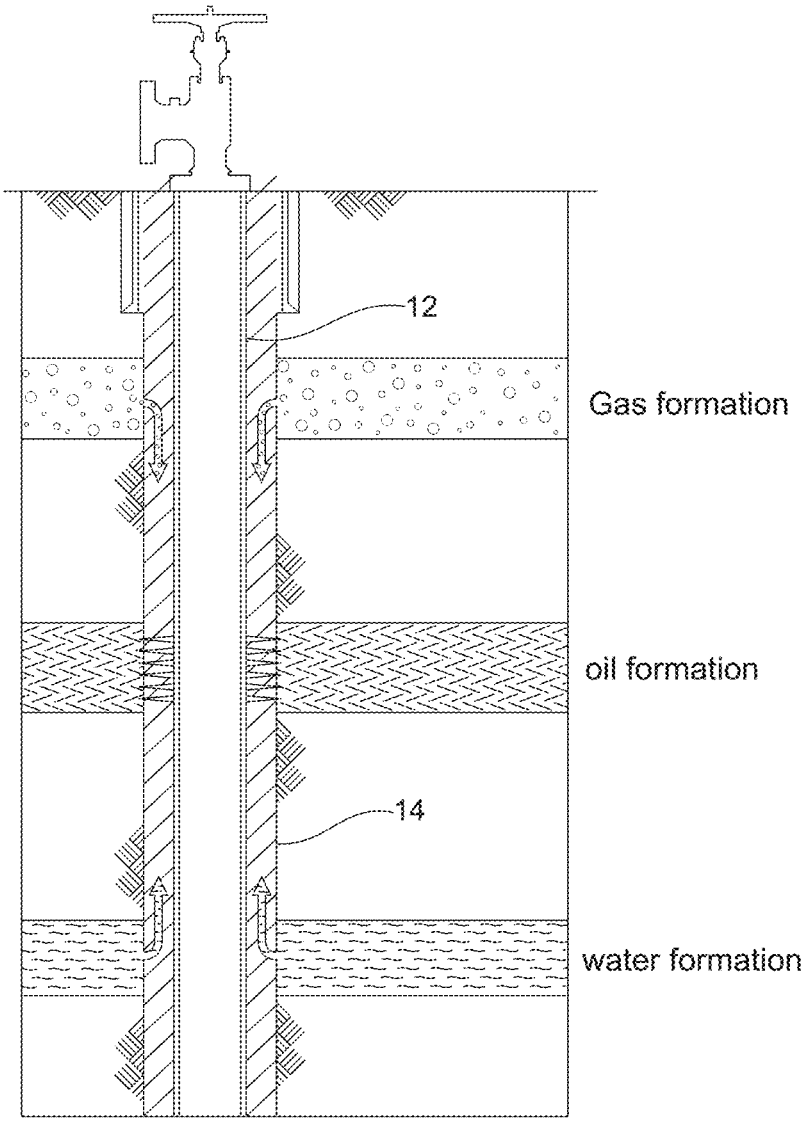
FIGS. 3A to 3C are diagrammatic representations of an inter-zonal communication mitigation operation utilizing casing expansion.
Figure 3B:
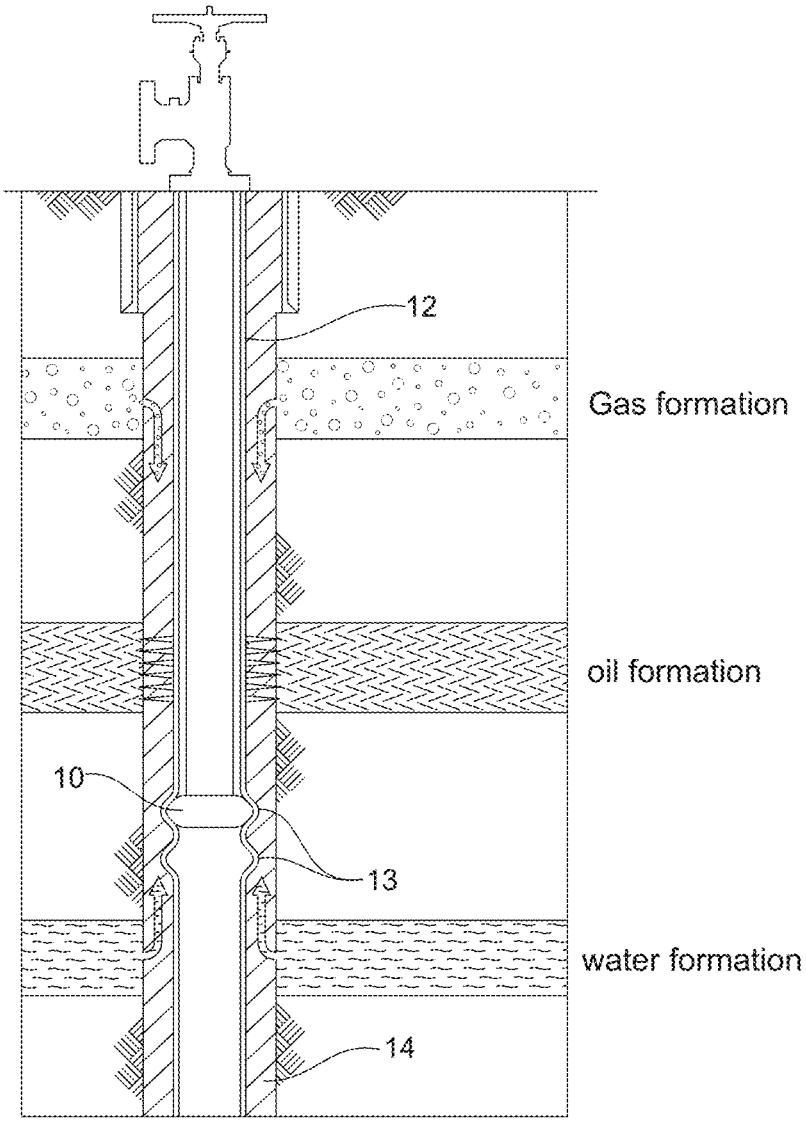
Figure 3C:
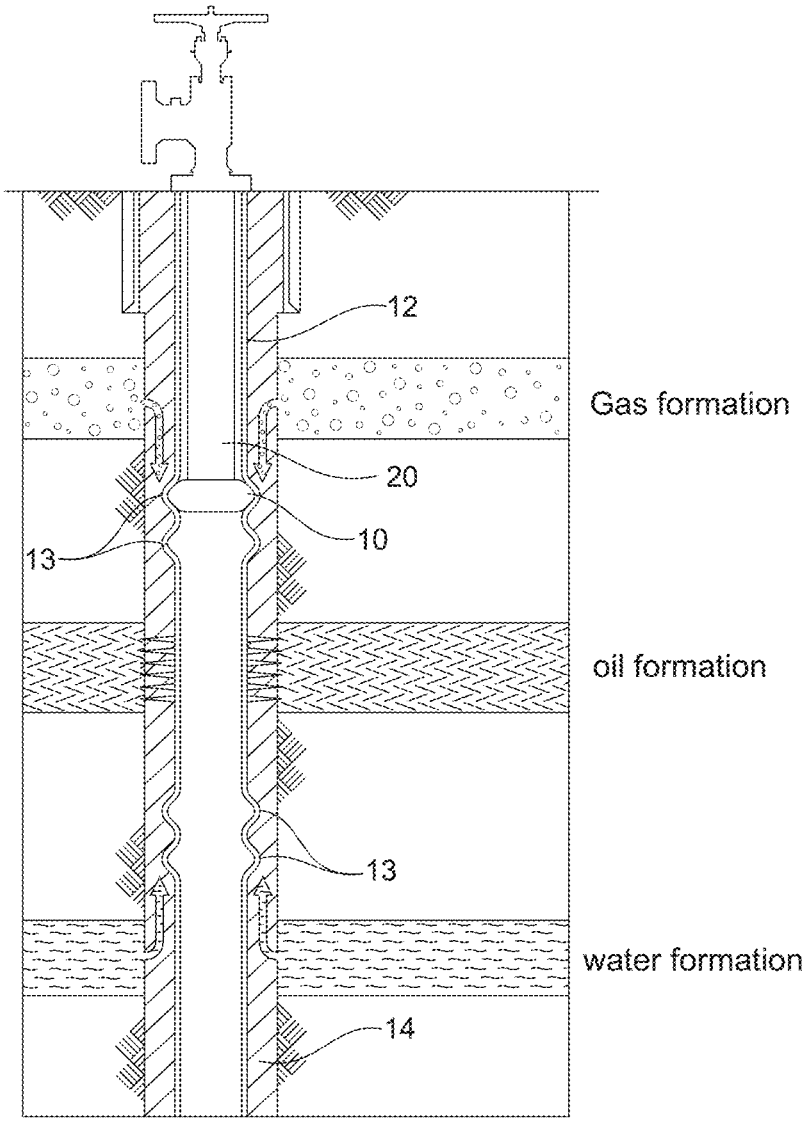

Turning to FIGS. 3A-3C, in instances where there is undesirable communication between various subterranean zones of the wellbore, such as an incursion of gas from a gas formation and water from a water formation into an oil producing formation via annular leak paths between the casing 12 and cement sheath 14, casing expansion may be utilized to mitigate or prevent such communication. As shown in FIGS. 3B and 3C, the setting tool 20 can be run into the wellbore to expand the casing 12 at one or more expansion locations 13 axially intermediate the oil producing, gas, and water formations to prevent communication therebetween via annular leak paths. As above, said expansion locations 13 can be located at portions of the casing 12 either having a cement sheath 14 thereabout or not having a cement sheath 14. While FIGS. 3A-3C depict casing expansions formed between gas, water, and water formations to prevent unwanted communication therebetween, casing expansion can be used to prevent communication between any two or more subterranean zones via microannular leak paths in the casing annulus.

An example of a suitable setting or casing expanding tool 20 for the operations above is described herebelow.

Setting Tool/Casing Expanding Tool

Figure 4:
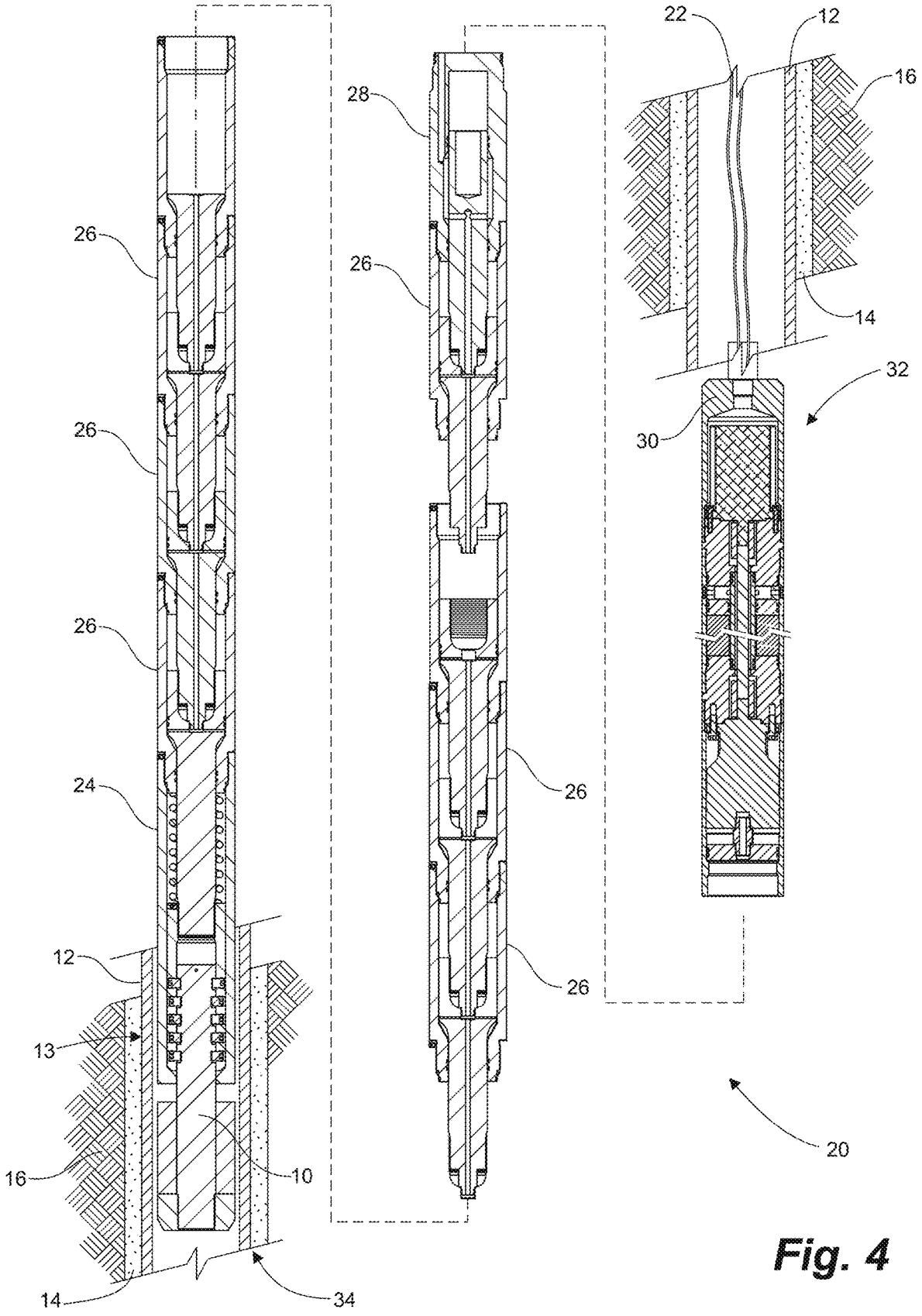
FIG. 4 is an expanded cross-sectional view of a wireline setting tool and expansion element according to one embodiment.

With reference to FIG. 4, in an embodiment of a suitable casing expanding tool 20, a casing expansion element 10 is provided for localized and permanent expansion of well casing 12 at a target location 13.

The setting tool 20 is provided for running the expansion element 10 downhole to the target location 13 and actuation thereof for plastically expanding the casing 12. The casing 12 is expanded into the cement sheath 14 surrounding the casing 12 within subterranean formation 16. The cement sheath 14 is compressed at the point of expansion. Permanent deformation of the casing 12 maintains contact of the expanded casing 12 with the compressed, volume-reduced cement sheath 14.

Applicant notes that others have determined that, surprisingly, integrity issues of the cement sheath 14, including micro-annular channeling and fractures, do heal after having experienced significant compression. Once one has determined a casing expansion location 13 of the well casing 12, such as a location of the casing 12 experiencing an annular leak, the casing is expanded permanently, and with a diametral magnitude to remediate leaking thereby. As set forth in IADC/SPE SPE-168056-MS, entitled "Experimental Assessment of Casing Expansion as a Solution to Microannular Gas Migration," it was determined that expanding casing through a swaging technique, applied generally along a casing, compresses the cement, and though the cements consistency changes it does regain its solid structure and compressive strength.

In the embodiment disclosed herein, the expansion element 10 is a material or metamaterial which accepts an axially compressive actuation force resulting in radial expansion. More commonly known as Poisson's Ratio as applied to homogeneous materials, it is also a convenient term for the behavior of composite or manufactured materials. Sometimes such manufactured materials are referred to as meta-materials, usually on a small material properties scale, but also applied here in the context of an assembly of materials that are intractable in a homogenous form, e.g. a block of steel, but are more pliable in less dense manufactured forms.

The expansion element is conveyed down the well casing 12 by the setting tool 20, on tubing or wireline 22 (as shown) to the specified location 13 for remediation. The setting tool 20 imparts significant axial actuating forces to the expansion element for a generating a corresponding radial expansion. The force of the radial expansion causes plastic deformation of the casing 12 at the specified expansion location(s) 13.

The setting tool 20 comprises an actuating sub 24, one or more piston modules 26, 26 . . . , a top adapter sub 28, and a power unit 30.

The setting tool 20 has an uphole end 32 for connection with the wireline 22 typically incorporated with the power unit. The expansion element 10 is operatively connected at one end or the other of the setting tool. In an embodiment, the expansion element 10 is supported at a downhole end 34, at the actuating sub 24, and thereby separates a conveyance end from the expansion element end.

When the setting tool is equipped with an expansion element 10 for single use, such as the stack of pleated rings described below, is configured with the expansion element 10 at the downhole end 34, permitting release and abandonment of the expansion element downhole and subsequent recovery of the setting tool 20 by pulling-out-of-hole thereabove. An expansion element 10 capable of multi-use could be located at either end, but is practically located again at the downhole end 34 as illustrated for separation again of conveyance and expansion functions, or for emergency release of the more risky expansion element.

Pleated Expander

With reference to FIGS. 5A, 5B, 5C and 6, in one embodiment, the expandable element 10 is a metamaterial assembly of metal components, some of which are folded, which have a high compressibility as the metal is forced to unfold and rigid metal components to control the axial and radial behavior of the folded metal. Actuation of the pleated ring—form of expandable element 10 results in irreversible deformation thereof and is intended for single use.

This embodiment of the expandable element 10 is a stack 40 of pleated rings 42 slidably mounted on a mandrel 44. Each ring 42 is separated and spaced axially apart from an adjacent ring 42 by a flat, annular washer 46. The behavior of pleated rings 42 for sealing a wellbore within the well casing 12 is also described in Applicant's international application PCT/CA2016/051429 filed Monday, Dec. 5, 2016 and claiming priority of CA 2,913,933 filed Dec. 4, 2015.

Figure 5A:
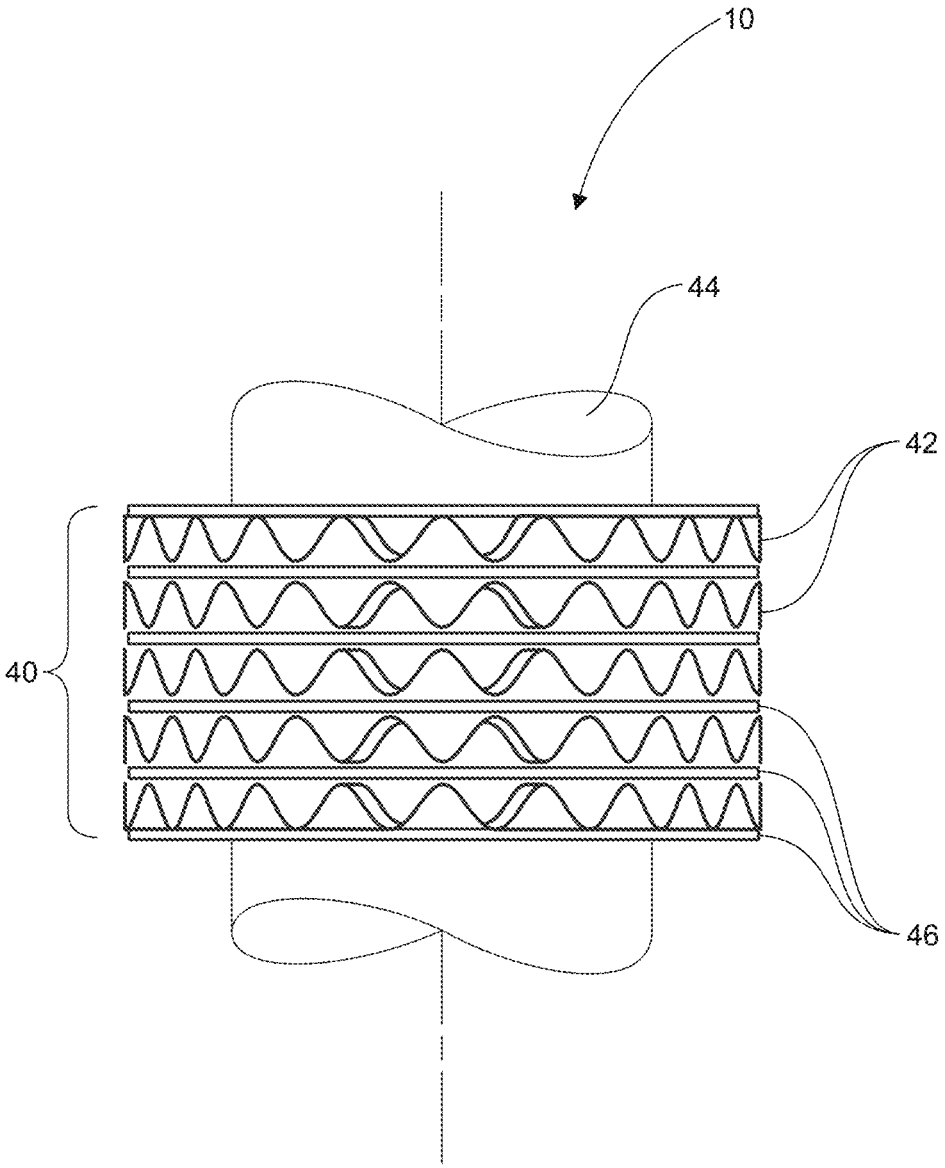
FIG. 5A is a side view of a single use, pleated ring expansion element installed about a mandrel.

As shown in FIG. 5A, the material of the annular pleated rings 42 is formed to undulate axially about the circumference of the ring like a wave disk spring. The pleated ring 42 can be axially compressed against a stop and as the pleat of the ring 42 flattens the added material in the flattened plane results in an increase in the ring's diameter. Like the ubiquitous Belleville spring washers, pleated rings 42 can be stacked in parallel for increase spring resistance or in series for increased deflection. Pleated rings 42 also have a greater capability for both axial and deflection and radial expansions than do the Belleville washers. Two or more pleated rings 42,42 . . . can be aligned axially in parallel, with the peaks and valleys aligned to increase the axial resistance to compression or misaligned angularly and separated by the washers 46 for serial stacking to minimize axial resistance and thus minimize actuation force. The stack 40 of pleated rings 42,42 . . . forms the expandable element 10.

Figure 5C:
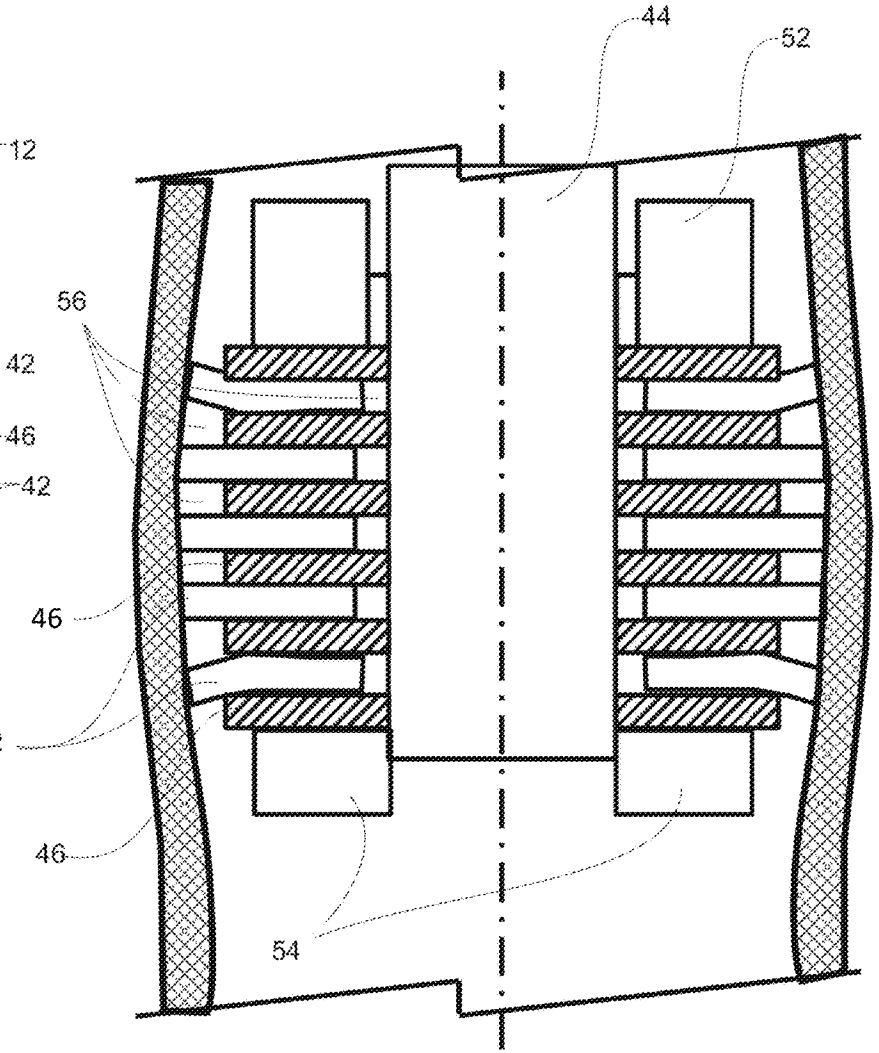
FIG. 5C is a cross-section of the single use, pleated ring expansion element of FIG. 5B after actuation.
Figure 5B:
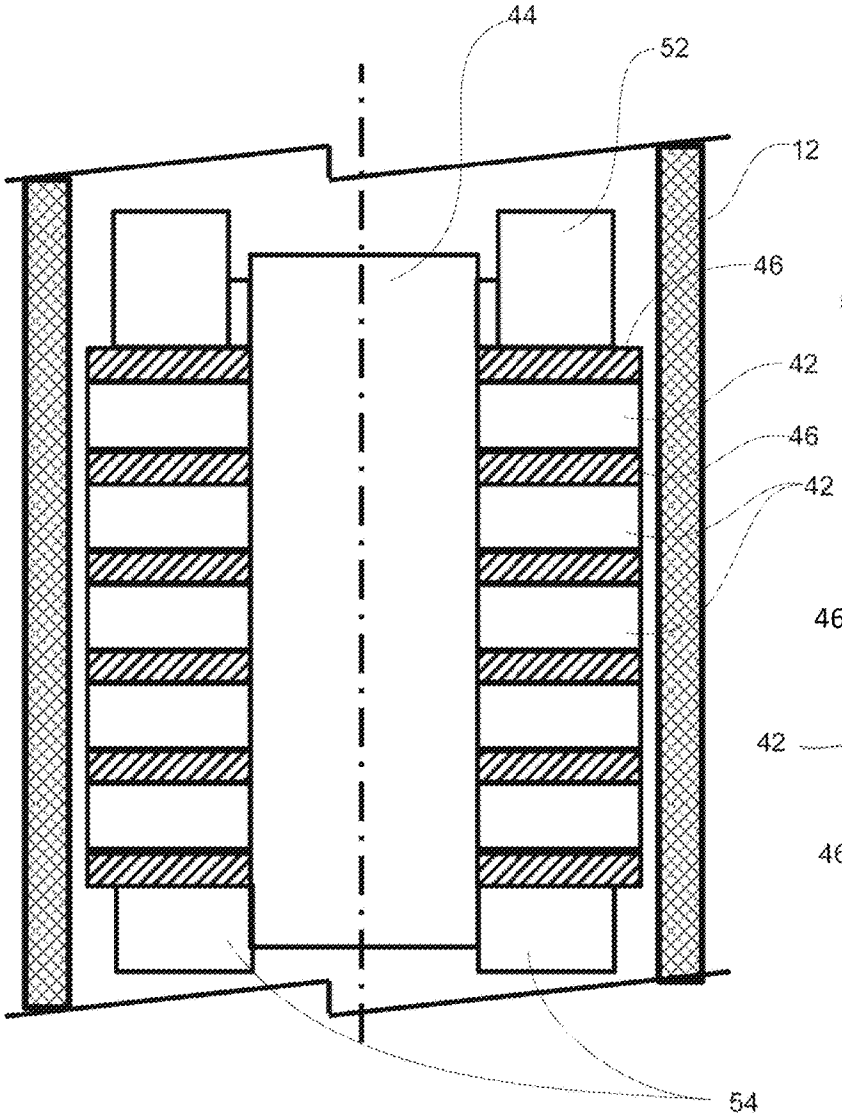
FIG. 5B is a schematic representation of a cross-section of a single use, pleated ring expansion element deployed in casing.

With reference to FIGS. 5B and 5C, a top and bottom of the expandable element 10 is supported axially by first and second stops 52,54 being actuable towards the other stop for compressing the stack 40. In this illustrated embodiment the bottom of the stack 40 is guided axially by the mandrel 44. When actuated, the pleated stack 40 is compressed axially between the first and second stops, so as to cause the pleated rings 42 to flatten between each washer 46.

Figure 6:
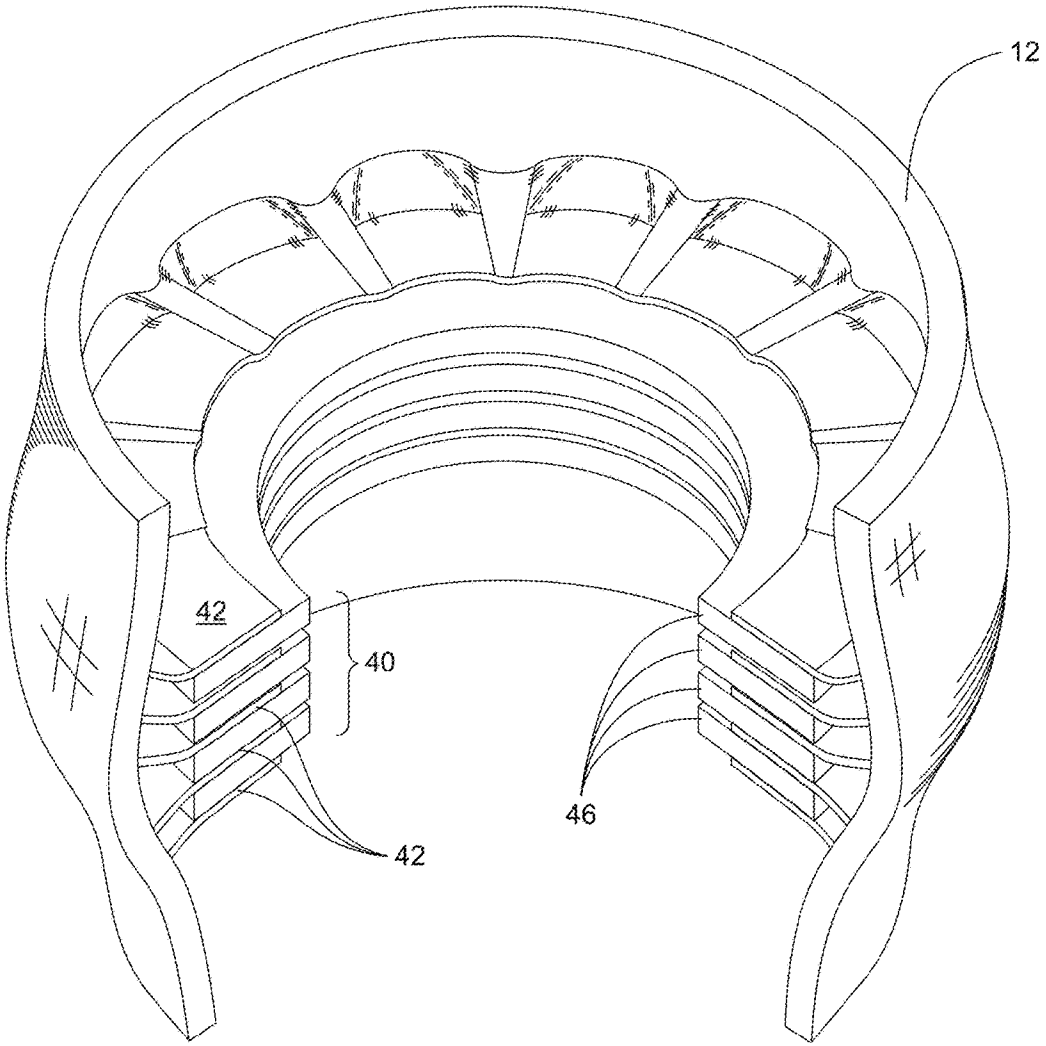
FIG. 6 is a drawing representation of a photograph of a partial section of 5.5" casing expanded by a single use expansion element according to Example 1.
Figure 7B:
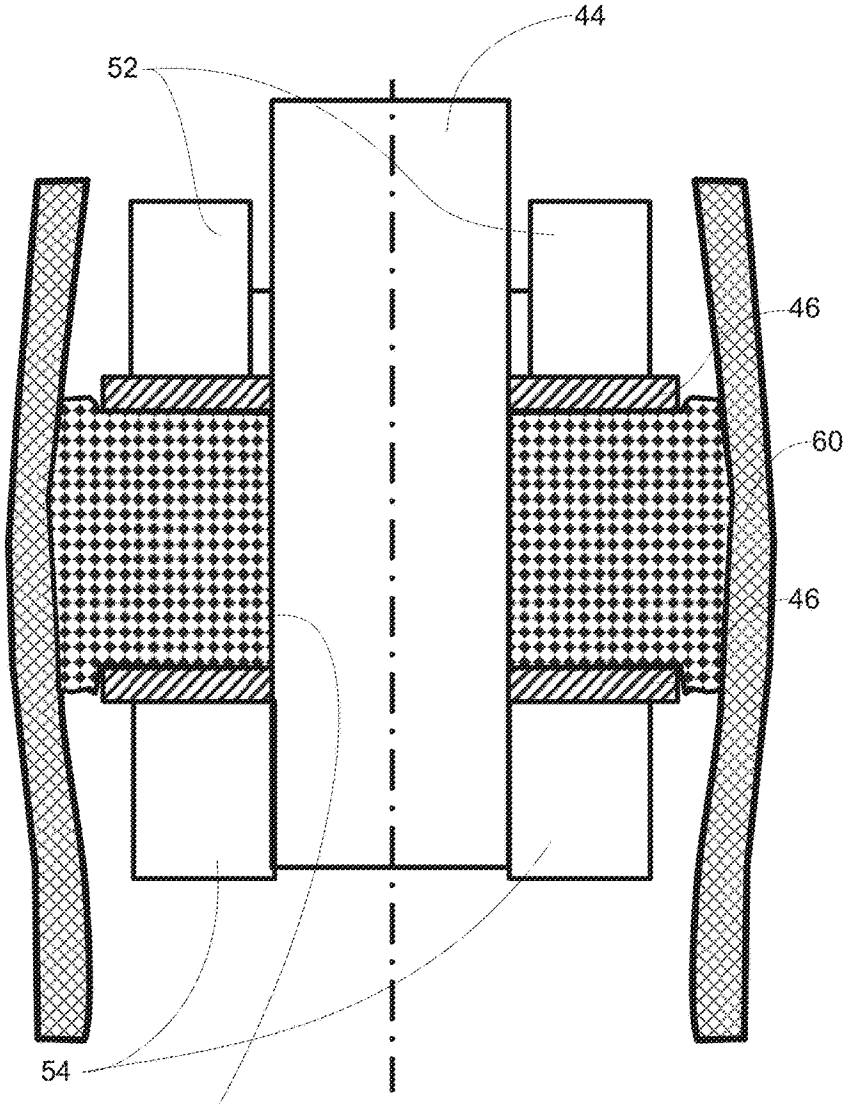
FIG. 7B is a cross-section of the a multi-use, resettable elastomeric expansion element of FIG. 7A after actuation.
Figure 7A:
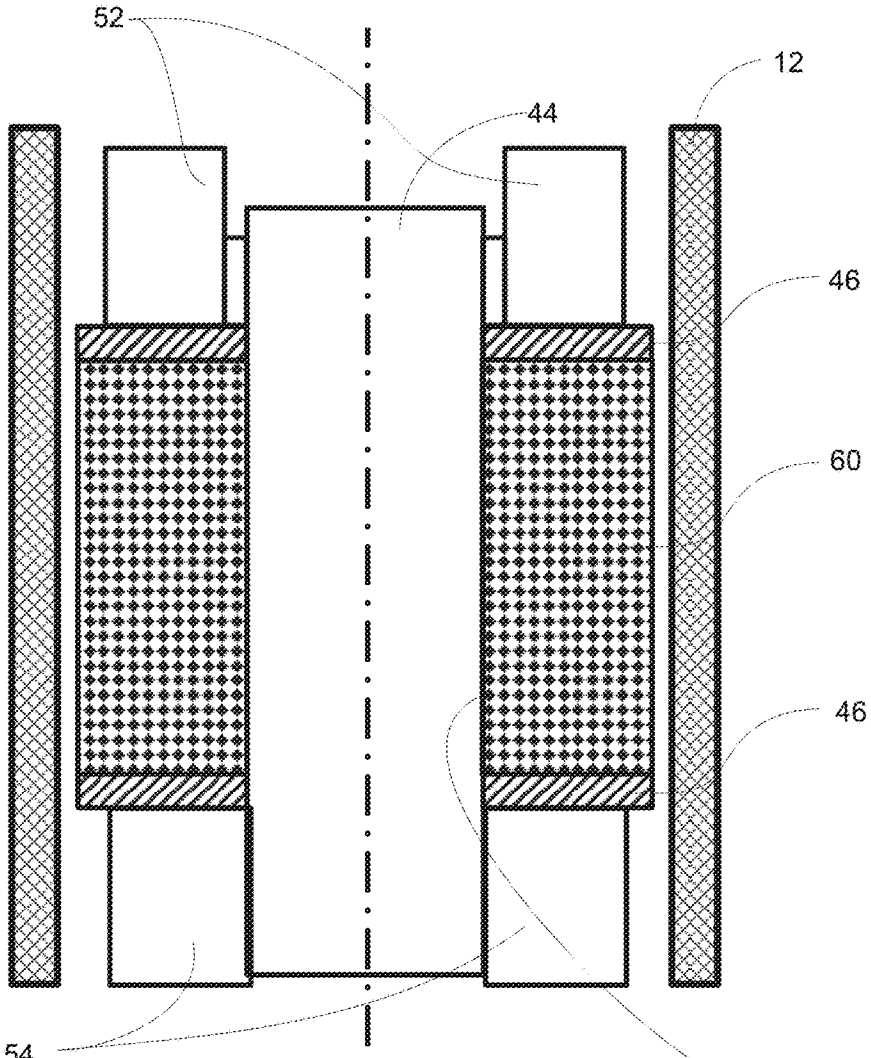
FIG. 7A is a cross-section of a multi-use, resettable elastomeric expansion element deployed in casing.
Figure 8B:
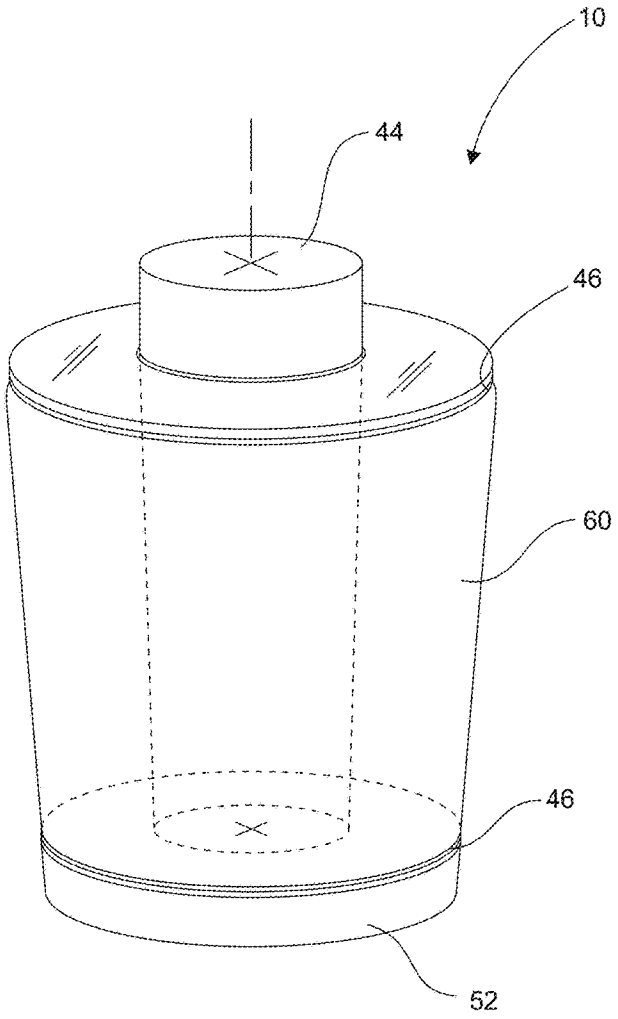
FIGS. 8A and 8B are drawing representations of a photograph of a partial section of 5.5" casing and a multi-use expansion element respectively, the casing having been plastically expanded by the multi-use expansion element of FIG. 13B.
Figure 8A:
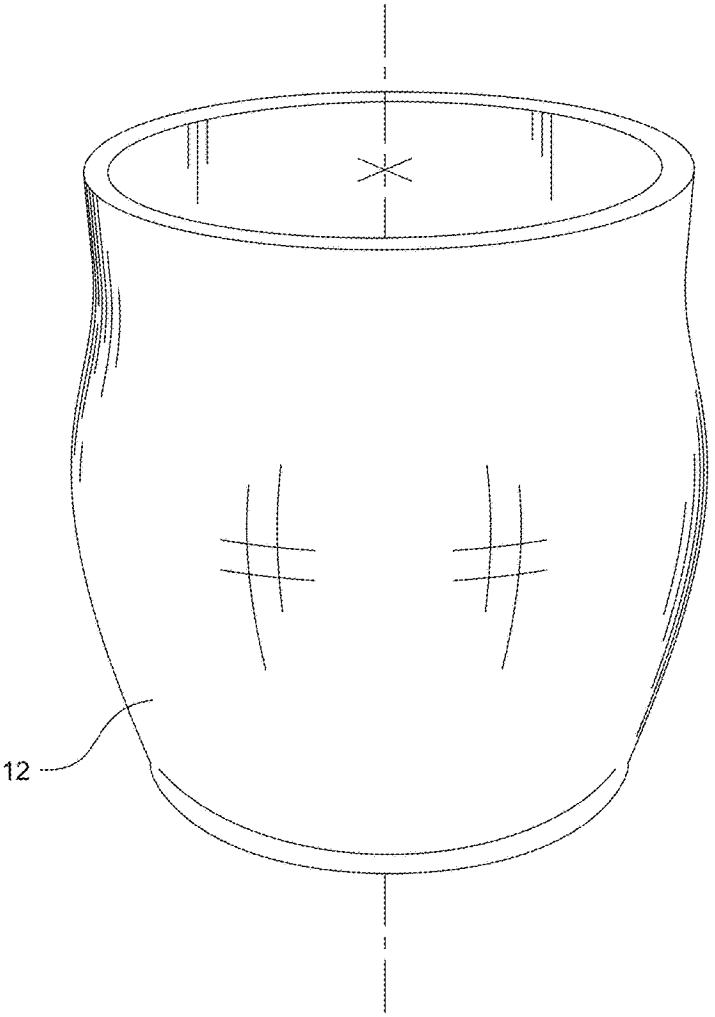

As shown in FIGS. 5C and 6, when flattened axially, each ring 42 expands radially, the expanding rings 42 engaging the inside diameter of the casing 12. As the rings 42 are axially restrained while compressed, dimensional change is directed into a radial engagement with the casing 12, the magnitude of which results in a plastic displacement thereof.

The overall axial height of the stack of pleated rings is limited to concentrate the radial force and hoop stress into the short height of the casing 12. The radial force displaces the casing beyond its elastic limit and imparts plastic deformation over a concentrated, affected casing length for a given axial force. The magnitude of the plastic expansion can be controlled by the magnitude of the axial force As shown in FIG. 6, a 5" tall stack of pleated rings 42, having a pleated outer diameter of about 4.887", can be deployed in 5.5", 14 lb/ft casing (5.012" internal diameter ID—nominal 5.5" OD). Depending upon the magnitude of the axial compression, the outside diameter of the casing is readily expanded in the order of 0.875". If evenly distributed circumferentially about the casing 12, this results in a reduction of almost ½ of the radial dimension of the cement sheath 14. Applicant has determined that an expansion of 0.375" on the casing diameter has been effective to shut off surface flow along the cement sheath 14.

In a first example, Example 1, a test expansion element 10 was prepared and comprised a stack of five double-pleated rings 42 separated and isolated by six flat spacer washers 46 for a stack height of about 4.6" to 5.1". The stack height controls the amount of diametrical expansion. The greater the pleat height, the greater the casing expansion. Each ring 42 was a 0.042" thick, fully hardened stainless steel. Between each pleated ring 42 was a strong 0.1875" thick washer 46 of QT1 steel having a 4.887 OD and a 3.017 ID. A 3" diameter test mandrel 44 was provided.

In testing, compression of the stack reduced the stack height by about 1.0" to 1.5" for the 3/16" thru 7/8" expansion respectively. For 5.5", 14 lb./ft J55 casing, having 5.012 ID, a nominal 5.5" OD and a 4.887 drift size. The initial dimensions are 4.887 OD with a 3.017" ID. The flattened ID and OD width varies with the initial pleat height.

At 90 tons (180,000 lbs force) of axial load to flatten the pleats, the OD of a pleated ring 42, having an initial 0.280" pleat height, expanded in diameter from 4.887" OD to 5.280" OD and the ID expanded from 3.017" to 3.410" ID. This resulted in about a 3/16" casing expansion.

For a ring having a 0.380" pleat height, when flattened, expanded in diameter from 4.887" OD to 5.655" OD and the ID expanded from 3.017" to –3.785 ID. This resulted in a ⅞" casing expansion. Applicant believes that the measurements scale proportionately up and down from 4" to 9⅜" casing.

In other embodiments Applicant may use a semi-solid viscous fluid embedded in the assembled stack 40 to add greater homogeneity thereto. When flattened, the individual pleats impose a plurality of point hoop loads on the casing. Applicant determined that a more distributed load can result with the addition of the viscous fluid or sealant 56 located in the interstices of the stack 40.

A suitable sealant 56 is a hot molten asphaltic sealant that becomes semi-solid when cooled. The stack of pleated rings 42 can be dipped in hot sealant and cooled for transport downhole embedded in the stack between the rings 42 and the washers 46 and within the valleys of the pleated rings 42 themselves. Plastomers are used to improve the high temperature properties of modified asphaltic materials. Low density polyethylene (LDPE) and ethylene vinyl acetate (EVA) are examples of plastomers used in asphalt modification. The sealant can be a molten thermo—settable asphaltic liquid, typically heated to a temperature of about 200° C. Such as sealant is a polymer—modified asphalt available from Husky Energy™ under the designation PG70-28. The described sealant melts at about 60° C. and solidifies at about 35° C.

The semi-solid sealant 56 in the stack of pleated rings, when actuated to the compressed position, seals or fluid exit is at least restricted from between adjacent washers, the mandrel, the adjacent pleated rings and the casing, for further applying fluid pressure to the wall of the casing 12.

Expansion elements 10 assembled from metal tend to be irreversible; once expanded they remain expanded, and as a result tend to become integrated with the casing 12 and thus cannot be reused.

Applicant is aware of wells that have multiple sources of leakage along the casing annulus, and it is advantageous to be able to expand the casing 12 at multiple locations 13,13 without having to trip out of the well casing 12 to install a new expandable element 10.

Elastomeric Expander

Accordingly, and with reference to FIGS. 7A, 7B, 8A and 8B, in another embodiment, a multiple-use casing expansion element 10 is conveyed downhole and actuated at the target location 13 to expand the casing 12, released, and then moved to a successive location. The magnitude of expansion is related to axial actuation force.

An elastomeric cylindrical bushing 60 has a central bore 62 along its axis and is mounted on the mandrel 44 passing therethrough. A suitable elastomeric material is a nitrile rubber, 75 durometer. A bottom of the bushing 60 is supported axially by a downhole stop 54 at a bottom the mandrel 44. A support washer 46, similar to the washers 46 used in the stack 40 of pleated rings.

The actuator sub 26 is fit with an uphole stop 52. When actuated, the bushing 60 is compressed relative to the bottom stop 52, so as to cause the bushing to expand radially related to its Poisson's ratio, engaging the casing 12. As the bushing is axially restrained and compressed, dimensional change is directed into a radial engagement with, and a plastic displacement, of the casing. Again, total axial height of the bushing is limited to concentrate force and maximize hoop stress in the casing 12 for a given axial force.

Generally, the diameter of the mandrel 44 is sized to about 50% to 75% of the outside diameter of the bushing 60. The inside diameter of the bushing 60 is closely size to that of the mandrel 44. For example, for 5.5" 14 lb/ft casing, the bushing height is 5" tall, the OD is 4.887" and the mandrel OD and bushing ID can be 2.125". Rather than changing out the mandrel for different sized elements 10, one can sleeve the mandrel for larger elements. Not shown, the mandrel 44 can also be fit with sleeve for varying the OD to fit the ID of larger bushings. For 9⅝" 40 lb/ft casing, having a bushing OD of 8.765", a 2.125" mandrel provided with a setting tool for 5.5" casing, can be sleeved to about 4" OD for the larger busing 60.

The elastomeric expansion element 10 has been tested with both 5.5" and 7" casing configurations. In both instances the element 10 has been about 5" tall which creates a bulge or plastic deformation along the wall of the casing 12 of about 3", consistent with the 5" tall pleated ring system.

In both sizes, the lighter weight casing 7", 17 lb/ft J55 and 5.5", 14 lb/ft J55 having wall thicknesses of about 0.25") expands to the point of permanent deformation between 80-90 tons of axial force.

The clearance, or drift, between the outer diameter of the expansion element 10 and the ID of the casing 12 is typically about ¼", or a ⅛" gap on the radius. In the case of an elastomeric element, capable of multi-use, partial extrusion of the elastomer is inevitable, but discouraged. Beveling of the uphole and downhole stops 52,54, or intermediate washers 46,46, minimizes cutting of the elastomer.

Use of a sleeve on the mandrel, or changing out the mandrel for a larger size keeps the thickness of the annular portion of the element generally constant. As stated, in the 5.5 and 7 inch casing the permanent diameter expansion is typically ⅝" to ⅞".

The casing expansion behaves predictably with increasing axial force and increasing diameter once the steel of the casing begins to yield. Applicant has determined that it is possible to expand casing diameter by up to 1.6" which would completely fill the cement sheath's annular space between most casing and formation completions.

As discussed, the expansion element 10 plastically deforms the casing so that the diametral compression of the cement sheath 14 is maintained after actuation and further, in the case of a multi-use element, after removal of the expansion element 10 for re-positioning to a new location. While the magnitude of the plastic deformation can be larger than that required to shut off the simplest SCVF, it is however a conservative approach to ensure that all of the cement defects are resolved, including, micro-annular leak paths, radial cracks, "worm holes" and poor bonds between cement and geological formation. The minimum expansion provided is that which creates a permanent bulge or deformation in the casing that does not relax when the force is removed.

In testing, Applicant has successfully multi-cycled the elastomeric elements for a dozen or more compression cycles. Applicant also notes that the elastomeric appears to translate the axial force to radial force slightly more efficiently than the pleated ring and viscous fluid system.

In scale up, it is expected that a 220 ton (440,000 lb)/ft setting tool will actuate the expansion elements for plastic deformation on thicker and more robust casing, such as the API 5CT L80 and P110 in about 26/ft casing weights (–0.50" wall thickness). Applicant has successfully tested P110 casing with axial loads of 170 tons and the expansion performance is similar to the same way that the tests for lighter casing.

Multi-Use Expansion

With reference to FIGS. 9 through 13, the materials characteristics of casing manufactured with welded seams, such as by electrical resistance welding, vary at the weld area. The welded seams are typically stiffer than the parent casing wall material and thus are variable in their resistance to expansion. Accordingly the resulting periphery of the expanded casing 12 can be asymmetrical, potentially resulting in less robust leak path remediation in the cement sheath at about the seam.

Figure 11:
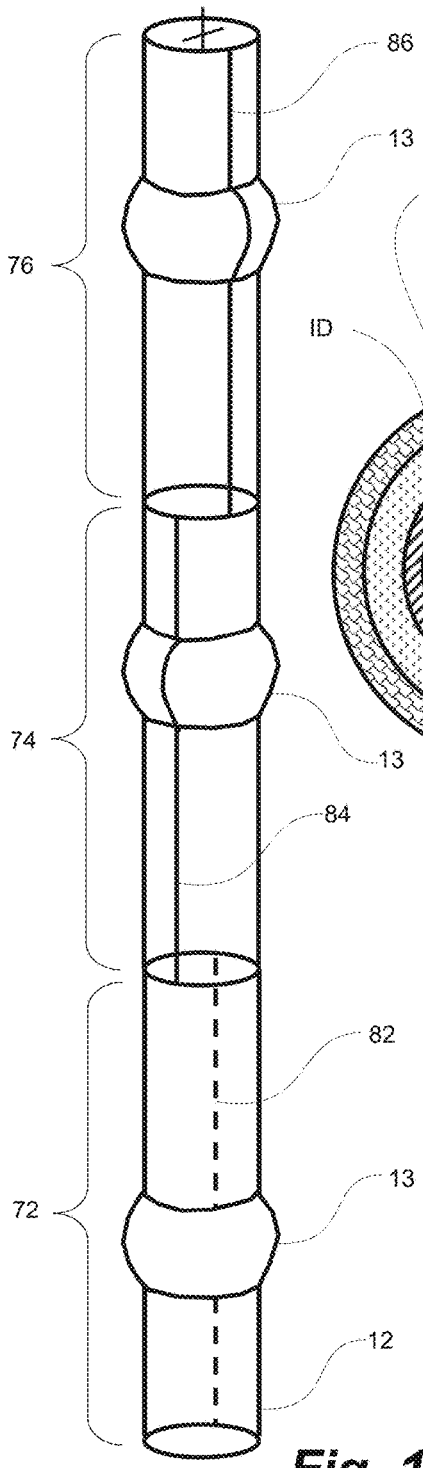
FIG. 11 is a side perspective view of three joints of casing, each joint having a weld seam at a different circumferential location, each joint having had a target location expanded using a multi-use expansion element.
Figure 12:
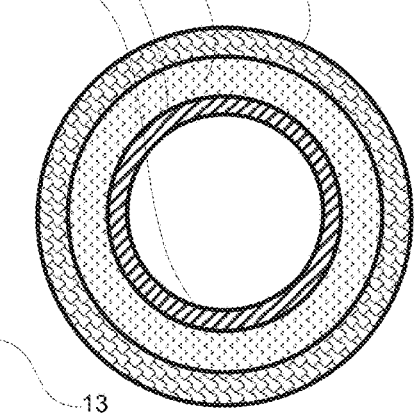
FIG. 12 is a cross-sectional view of the casing of FIG. 11 before expansion.

Accordingly, and with reference to FIG. 11, as a matter of chance, the seam of each connected joint of casing 12 is typically angularly offset from the preceding and subsequent joint. Thus in one embodiment, the setting tool 20 and expansion element 10 are operated at two or more locations spaced along the string of well casing 12. The joints of casing are typically 20-40 ft (6-12m) lengths and movement between successive joints 12 can be easily accommodated by the wireline or tubing conveyed setting tool 20. It is unlikely that any two separate joints of casing, and it is even less likely that three separate joints of casing have the weld seams aligned. Thus, by performing two or three expansions, the cement sheath is remediated about a full circumferential and annular coverage.

In the event that three, spaced expansions are not sufficient to shut off the SCVF, as evidence by surface testing, one can repeat as necessary without having to replace the elastomeric element.

Turning to FIG. 9 and FIGS. 10A through 10C, the setting tool 20 is illustrated with a plurality of piston modules 26. In an embodiment, the power module and piston modules provide about 17,000 pounds per module; for example, nine modules generate about 80 tons and 13 modules generate 110 tons.

Figures 9, 10A, 10B, 10C:
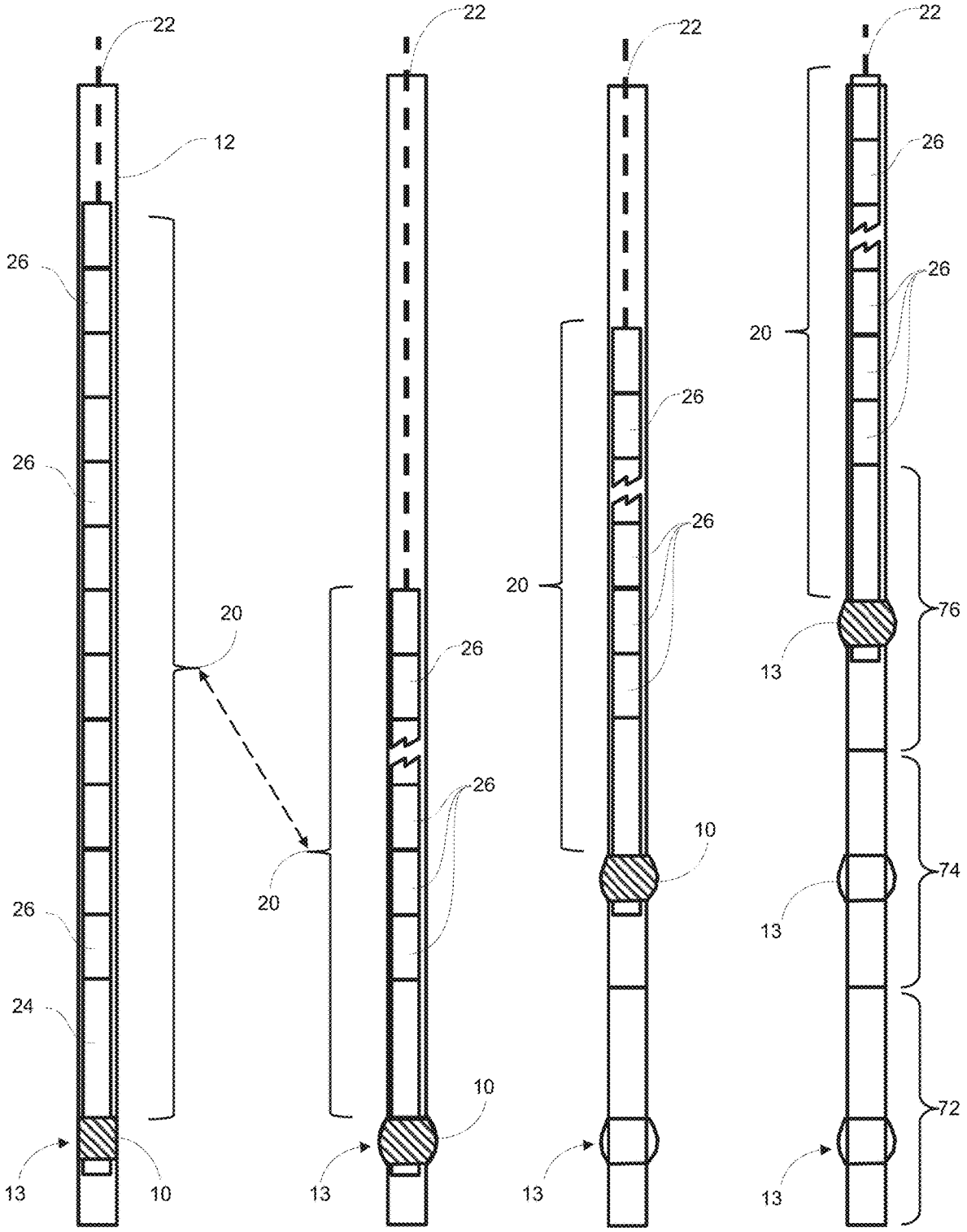
FIG. 9 is a schematic cross-sectional representation of a setting tool having a plurality of piston elements coupled to multi-use expansion element, such as that shown in FIGS. 8A,8B.
FIGS. 10A, 10B and 10C are schematic cross-sections of the setting tool and expansion element of FIG. 8A, actuated in a first joint of casing, moved uphole and actuated in a second successive joint of casing, and moved uphole and actuated in a third successive joint of casing.

As shown in FIG. 9 the setting tool 20 and an expansion element is conveyed downhole on a conveyance string or wireline 22 to a specified location 13 along the casing 12. At FIG. 10A, the setting tool 20 is shown broken in the middle and pistons not illustrated for display purposes. The element 10 is actuated radially outwards to plastically expand the casing 12 at the specified location 13.

At FIG. 10B, the setting tool 20 is actuated to release the expansion element 10. The element contracts radially inward from the casing 12 to its original run-in dimensions. Thereafter the setting tool 20 and expansion element 10 can be moved along the casing, typically uphole to a successive specified location 13 and repeating the actuating and element-releasing steps for expanding the casing 12 again. With reference to FIG. 10C, the expansion element is conveyed along the casing to a successive specified location and repeating the actuating and element-releasing steps.

Setting Tool

As introduced above, the setting tool 20 provides axial forces for actuating the expansion element 10 axially for a corresponding radial expansion.

With a reminder back to FIG. 4, the setting tool 2 comprises the actuating sub supporting the first uphole stop 52, the mandrel 44 and the second downhole stop 54, the piston modules 26, the top adapter sub 28, and the power unit 30.

Turning to FIGS. 14A through 17, the setting tool further comprises a modular tubular body having a contiguous bore 102 and a modular outer sleeve 104. The outer sleeve comprises a series of housings of at least the actuator sub 24, the piston modules 26 and the top adapter sub 26. The downhole end 34 of the outer sleeve forms a first uphole stop 52. The bore 102 of the actuator sub 24 is slidably fit with the 44 mandrel, and the mandrel is fit with the second downhole stop 54. Whichever expansion element 10 is selected is sandwiched between the first uphole and second downhole stops 52,54. Above the actuator sub 24, the outer sleeve 104 comprises the piston modules 26, each module having a piston housing or cylinder 108 fit with a hydraulic piston 106 sealably slidable therein for driving the mandrel 44 and connected downhole stop 54 towards the uphole stop 52, compressing the expansion element 10 therebetween.

Two or more of the pistons 106,106 . . . are coupled axially to each other and to the mandrel 44, such as through threaded connections. As the pistons 106, mandrel 44 and downhole stop 54 are hydraulically driven uphole, the outer sleeve 104 and uphole stop 52 are correspondingly and reactively driven downhole. Reactive, and downhole, movement of the outer sleeve 104 drives the uphole stop 52 towards the downhole stop 54.

Each piston 106 and cylinder 108 is stepped, providing a first uphole upset portion 116 and a second smaller downhole portion 118. The pistons uphole and downhole portions are sealed slidably in the cylinder 108. Hydraulic fluid F under pressure is provided to a chamber 120, situate between the uphole and downhole portions 116,118, which results in a net uphole piston area for an uphole force on the piston 106 and an equivalent downhole force on the outer sleeve 104.

Figure 15:
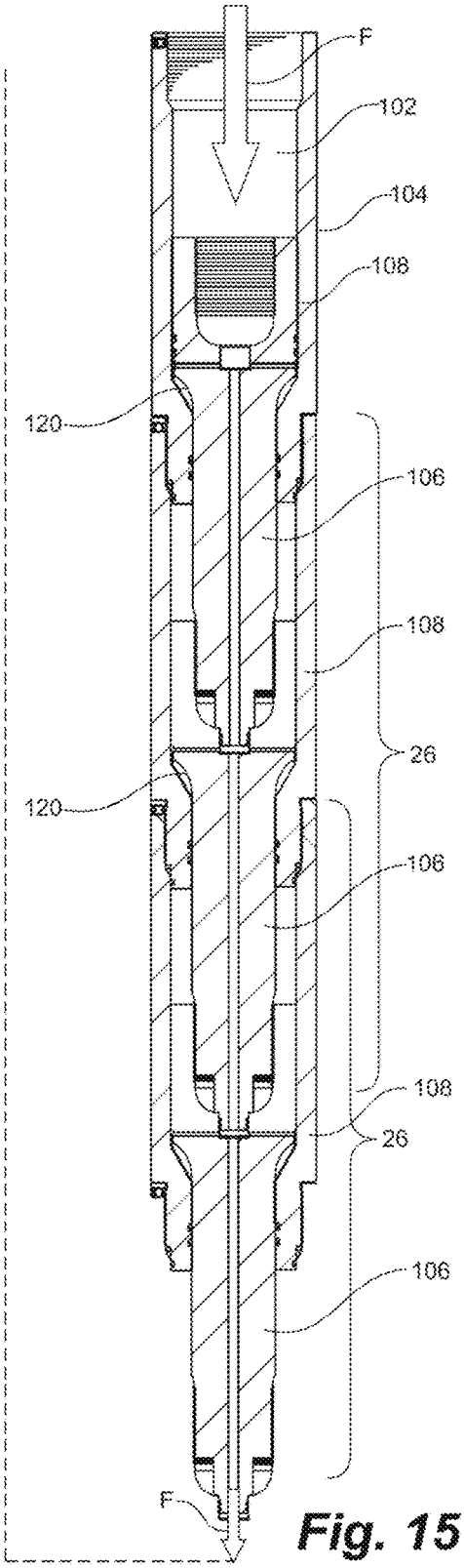
FIG. 15 is a cross-sectional view of several of the piston assemblies of the setting tool of FIG. 4.
Figure 16:
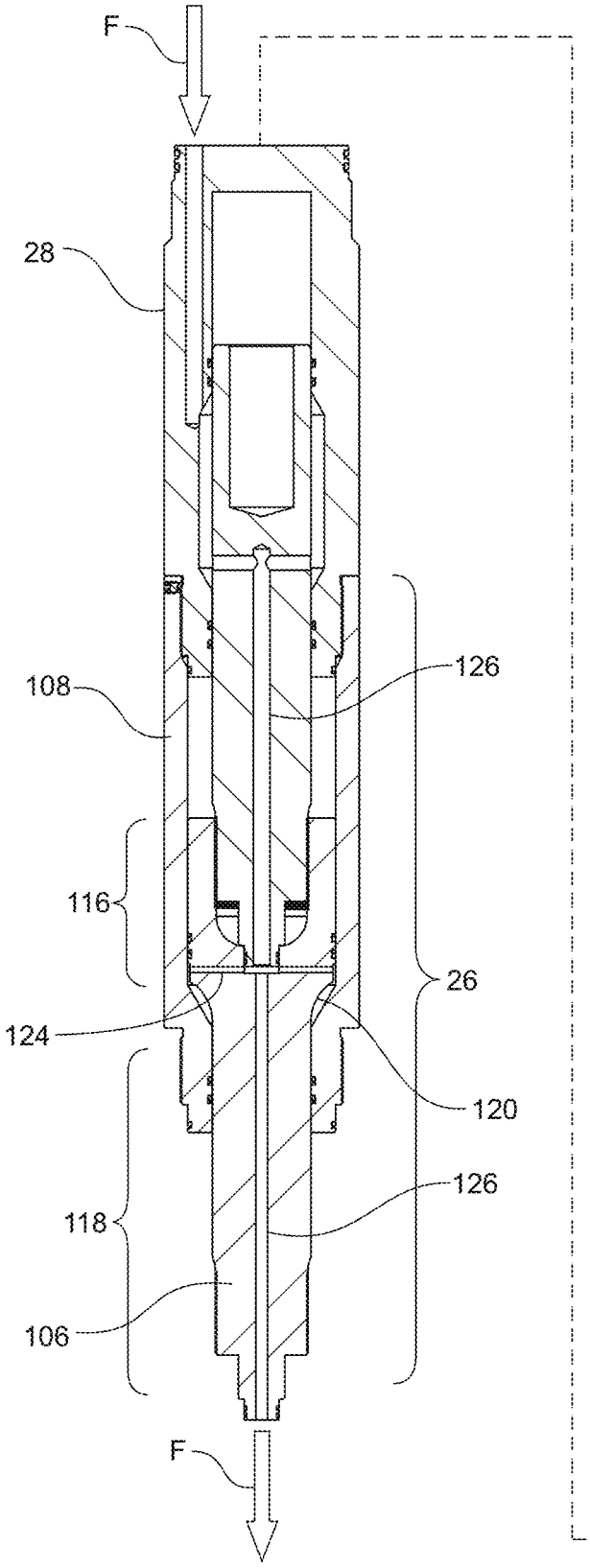
FIG. 16 is a cross-sectional view of a top sub of the setting tool having a piston and hydraulic piston distribution passages.

As shown in FIGS. 15 and 16, a plurality of the piston modules 26 are provided which can be assembled in series for multiplying the actuating force. Each module 26 comprises the stepped cylinder 108 and a stepped-piston 106 therein. As shown in FIG. 16 fluid supply passages 126 extend from the top adapter sub 28 through each piston 106 to the next piston 106. A transverse fluid passage 124 across the piston 106 is in fluid communication between the supply passage 126 and the chamber 120.

Figure 17:
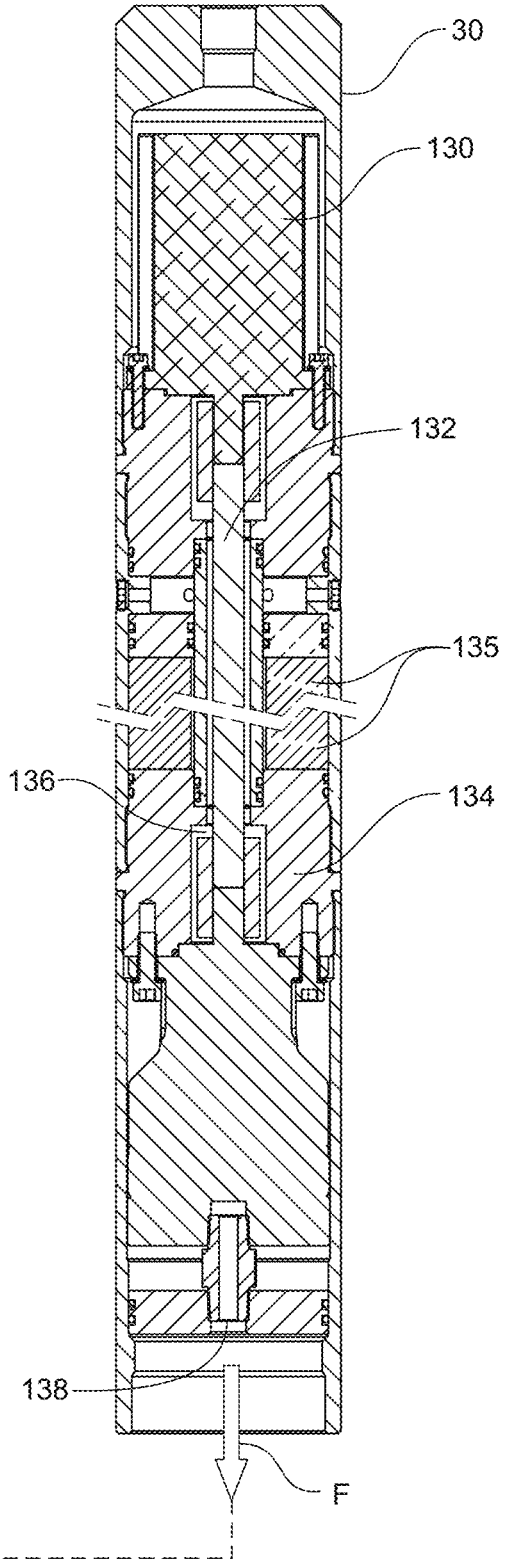
FIG. 17 is a cross-sectional view of the power sub having a motor and pump for an electrical wireline embodiment.

With reference to FIG. 17, the power sub 30 provides the actuating hydraulics for the piston modules 26. A motor 130, such as an electrical motor, is carried within the power sub and connected through the wireline 22 to a source of electric power at the well surface, the motor 130 having an output shaft 132. A hydraulic pump 134 is also carried within the power sub 30, having a fluid intake 136 and fluid output 138. The pump 134 is coupled to the output shaft 132 of the motor 130 and driven thereby. A hydraulic reservoir 135 can be fit into power sub, or a separate tank sub (not shown), having sufficient volume corresponding to the number and stroke of the piston modules 26. The fluid output 138 is in fluid communication with the ganged and stepped pistons 106, 106 . . . and supplies pressurized hydraulic fluid F to the chambers 120 between the pistons 106 and the cylinders 108 of the sleeve 104.

The actuator sub 24 includes the mandrel 44 and a piston connector 122 between the pistons 106 and the mandrel 44. If the expansion element 10 is a single use element, then the mandrel 44 is releasably coupled to the balance of the setting tool 20. The mandrel 44 can be fixed to the piston connector 122 or releasable therefrom. For a multi-use element, the mandrel 44 is not necessarily releasably coupled, the mandrel being required during each of multiple expansions along the casing 12. Regardless, as if conventional for downhole, multi-component tools, for emergency release the mandrel 44 can be coupled with s shear screw or other overload safety.

For the instance of a single use expansion element, such as the stack 40 of pleated rings 42, the mandrel 44 is releasably coupled to the adapter sub 24. The adapter sub 24 and mandrel 44 further include a J-mechanism 140 having a J-slot housing 142 and a J-slot profile 144 formed in the mandrel 44. The J-slot housing and J-slot profile are coupled using pins 146. The J-slot housing 142 is connected to the piston connector 122 for axial movement within the adapter sub's outer shell 104 as delimited by the J-slot profile 144. The J-slot housing, pin 146 and J-slot profile connect the piston connector 122 to the mandrel 44. For managing large axial loads, the J-slot profile 144 can have multiple redundant pin 146 and slot 144 pairs for distributing the forces.

Figure 14A:
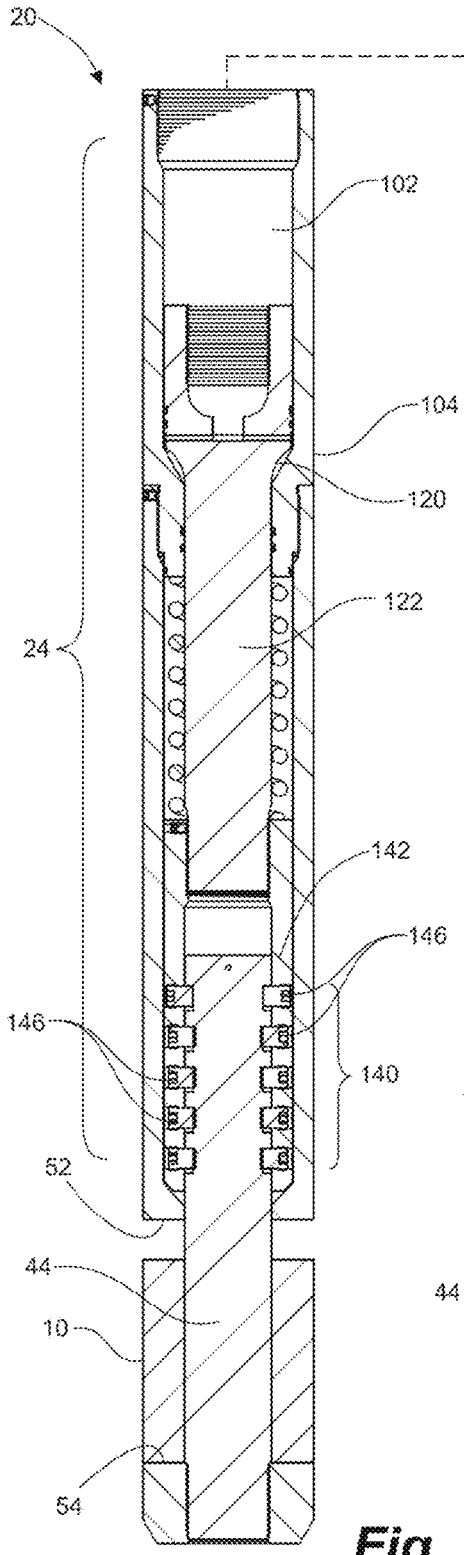
FIG. 14A is a cross-sectional view of the mandrel and shifting housing of the wireline setting tool of FIG. 4.
Figure 14B:
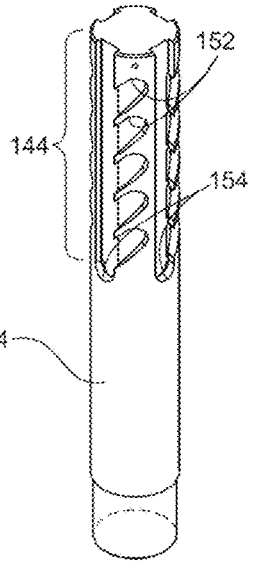
FIG. 14B is a perspective view of the mandrel and a J-slot profile for compression and release of the expansion element.

With reference to FIGS. 14A and 14B, each J-slot profile 144 has an uphole J-stop 152 for enabling axial force on the mandrel 44 and therefore the downhole stop 154 to compress the expansion element 10 against the uphole stop 52. Upon completion of the expansion step, the hydraulic force on the pistons 106, 106 is released and the J-slot housing 142, and pins 146 move along the J-slot profile 146 to an axial release slot 154. The J-slot housing 142 can be biased to a downhole position using a return spring 160 to release compression on the element 10. A suitable return spring rate can be about 185 lbs/in. When the spring 160 is compressed 2.50" results in a 462.5 lb force. The pins 146 align with the axial release slot 154 and the adapter sub 24 and setting tool 20 generally can be pulled free of and off of the mandrel 44. For stepped pistons having a large end OD of 3.187" and a small end of OD 2.127, an assembly of 10 pistons 106 will provided over 110 tons of force.

In the case of a multi-use expansion element, such as the elastomeric element 10, the mandrel 44 remains connected to the piston connector 122 for repeated compression and release of the element ad different specified location 13. If either single use or multi-use expansion elements are to be used with the same setting tool, the J-mechanism 140 for release of the mandrel maybe enabled or disabled. A disabled J-mechanism 140 may include a locking pin or J-slot blanks fit to the J-profile to prevent J-slot operations.

Operation

As described in more detail above, and with reference again to FIGS. 9 to 10C for multi-use operations, the setting tool 20 and an expansion element 10 are conveyed downhole to a specified location 13 along the casing 12. The element 10 is actuated radially outwards to plastically expand the casing 12 at the specified location 13. The setting tool 20 is actuated to release the expansion element 10.

The hydraulic fluid can be directed back the reservoir 135. The element 10 contracts radially inward from the casing 12 to its original run-in dimensions. Thereafter the setting tool 20 and expansion element 10 are moved along the casing 12, typically uphole, to a successive specified location 13 for repeating the actuating and element-releasing steps for expanding the casing 12 again. The expansion element moved from location to location along the casing for repeating the actuating and element-releasing steps.

Figure 13C:
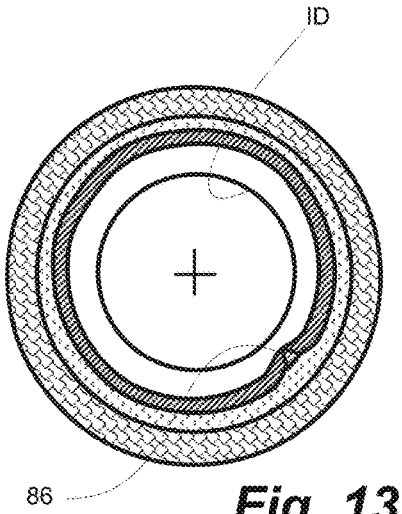
FIGS. 13A, 13B and 13C are cross-sectional views taken at the specific location of expansion for each of the three joints of casing of FIG. 11, each illustrating a stiff weld effect at a different circumferential location about the cement sheath.
Figure 13B:
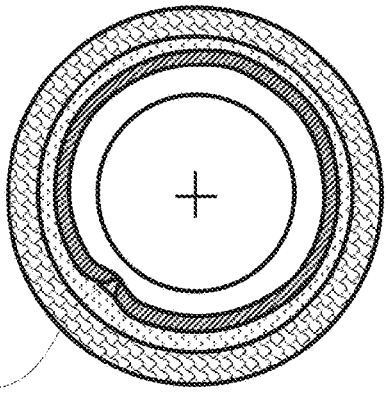
Figure 13A:
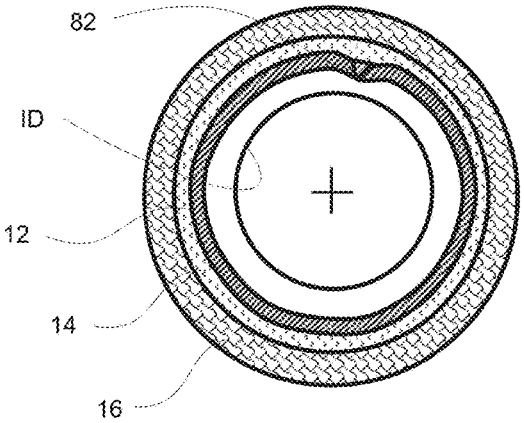

With reference to FIG. 11, three joints of casing 72,74,76 are illustrated, each having a seam 82,84,86 respectively. Note a fanciful, but typical rotational misalignment of the seams 82,84,86. FIGS. 13A, 13B and 13C correspond with cross sections of the expanded locations 13 for each joint of casing 72,74,76 respectively. In FIG. 13A, a less than uniform expansion of the casing 12 illustrated at the weld 82 with less compression and possibly less remediation of the cement sheath at that angular position. However, through a subsequent expansion for the successive joint 74,the similar expansion defect at the weld 84 is rotated relative to the weld 82 below, any axial path of gas up the cement sheath past weld 82 being captured by the successful remediation for the successive joint 74 above. Similarly, with reference to FIG. 13C, the third joint has a potential stiff weld expansion defect at weld 86, but it is unlikely to be axially in line with either of the lower welds 82,84, again sealing the cement sheath against imperfect remediation therebelow. It is expected that with the large plastic expansions now possible, even the areas of the casing have a weld seam will be sufficiently expanded to heal the cement sheath thereat.

Turning to the single use element of FIGS. 5A, 5B and 5C, and with reference also to FIGS. 18A through 18E, the method of operation includes running the setting tool 20 downhole, setting the element 10, releasing the element, abandoning the element and tripping out the setting tool.

Figures 18A, 18B, 18C, 18D, 18E:
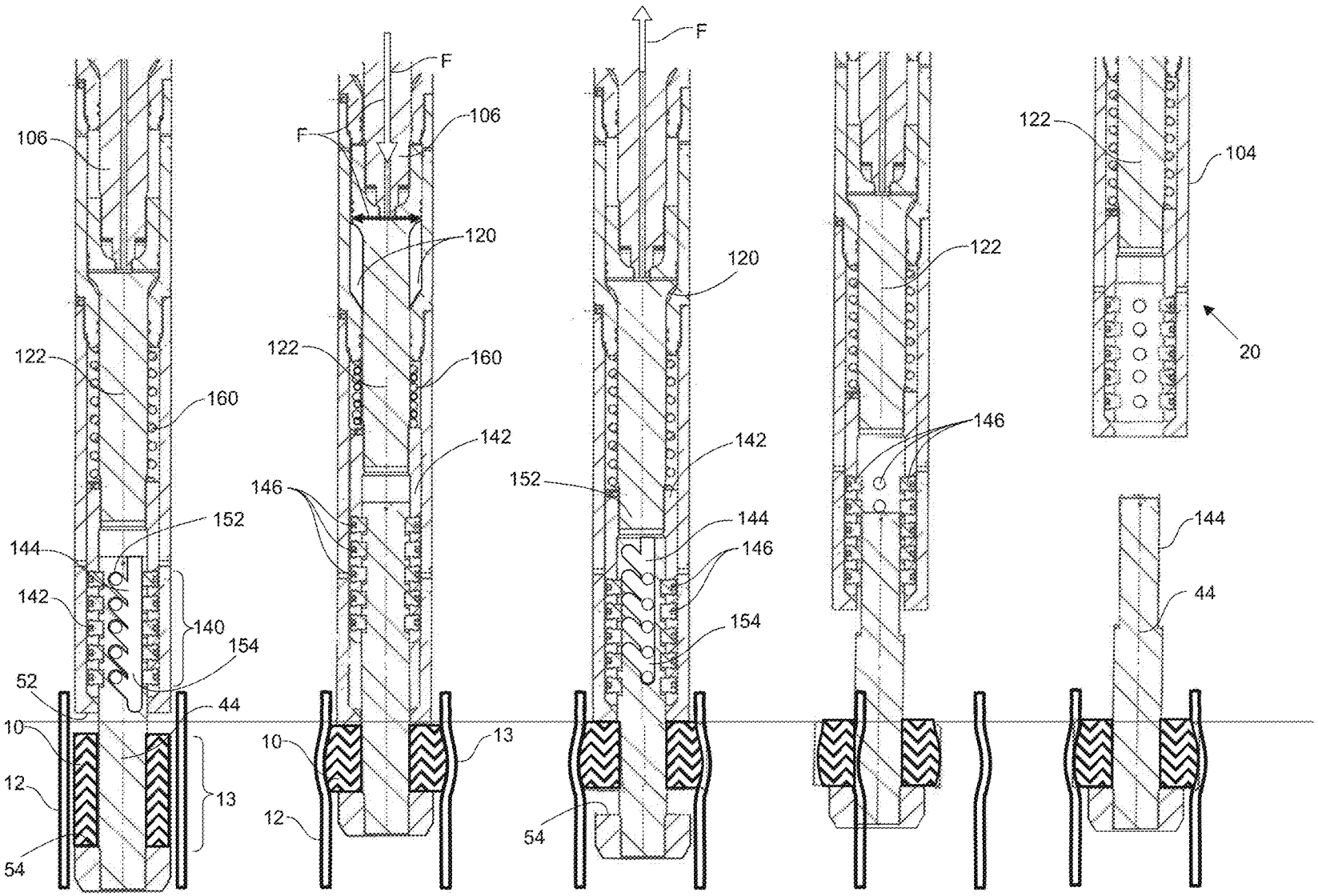
FIGS. 18A through 18E are sequential steps of the operation of the setting tool and a single use expansion element, namely running in hole to a target location, actuating the expansion element, releasing the settling tool from the mandrel, withdrawal of the setting tool from the mandrel and pulling the setting tool out of hole, respectively.

In FIG. 18A, the setting tool 20 and element 10 are run into the well casing 12 to a specific location 13. The power sub 30 provides fluid F to the pistons 106. The pistons 106 shift uphole, driving the downhole stop 54 uphole, compressing the element 10 against the uphole stop 52. In FIG. 18B, one can see a piston chamber 120 filled with fluid F and piston connector 122 uphole, and correspondingly the pins 146 of the J-slot housing 144 having pulled the mandrel and downhole stop 54 uphole to compress the element 10. As a result, sufficient load is applied to the expansion element 10 to expand the element radially into the casing 12 and plastically deform the casing 12 and impinge on the cement sheath at the location 13.

Turning to FIG. 18C, the hydraulic fluid pressure is released and return spring 160 drives J-slot housing 142 downhole. The housing pins 146 follow the J-slot profile 144 from the uphole stops 152 to the axial release slot 154. The single use expansion element 10 remains engaged with the casing 12 and the mandrel 44 may or may not move axially through the element 10.

With reference to FIG. 18D, as the pins 146 are axially aligned with the axial release slot 154 of the J-slot profile 144, setting tool 20 can be pulled uphole and the pins 146 move unrestricted along the slot 154 to leave the mandrel 44 behind in the casing 12. In FIG. 18E, the setting tool 20 continues uphole to surface.

The applicant's tool 20 enables axial actuation, at a specific location, for plastic expansion of tubulars of various configurations including liner hangers and casing patches. With axial setting forces now available in the hundreds of thousands of pounds, and an effective axial actuation to radial displacement, casing with wall thicknesses of up to ½" or more can be permanently plastically expanded. Such heretofore unavailable targeted expansion of casing 12 enables the control of flow of cement and other fluids along micro-annular leak paths formed between the casing 12 and surrounding cement sheath 14, and the improved wellbore cementing procedures, and mitigation of inter-zonal communication discussed above.

While certain embodiments of a setting tool/casing expanding tool 20 are described above, other devices capable of permanently plastically expanding the diameter of the casing 12 may be used to effect the casing expansions at the desired target locations 13.

We claim:

1. A method of cementing a wellbore having a wellbore casing extending therethrough, the casing having a casing bore, the method comprising:

conveying a casing expanding tool downhole to at least one expansion location along the casing;

actuating the casing expanding tool to plastically deform the casing radially outward at the at least one expansion location;

conveying a cementing string downhole through the casing bore to position one or more cement outlets of the cementing string proximate a target interval having one or more perforations formed through the casing, wherein the target interval is selected to include an uncemented length of the casing; and introducing cement from surface downhole through the cementing string and to the outside of the casing via the one or more perforations.

2. The method of claim 1, further comprising forming the one or more perforations through the casing at the target interval for establishing communication between the casing bore and an outside of the casing.

3. The method of claim 1, wherein the at least one expansion location is located downhole of the target interval.

4. The method of claim 1, wherein the at least one expansion location is located uphole of the target interval.

5. The method of claim 1, wherein the at least one expansion location comprises at least one uphole expansion location uphole of the target interval, and at least one downhole expansion location downhole of the target interval.

6. The method of claim 1, wherein the step of actuating the casing expanding tool further comprises actuating an expansion element of the casing expanding tool radially outwards and radially contracting the expansion element after the casing has been plastically deformed.

7. The method of claim 6, wherein the step of actuating the expansion element comprises axially compressing the expansion element to expand the expansion element radially outwards, and the step of radially contracting the expansion element comprises axially releasing the expansion element.

8. The method of claim 7, wherein the step of axially compressing the expansion element comprises actuating an axial actuator of the casing expanding tool to drive a second stop of the casing expanding tool toward a first stop of the casing expanding tool, and the step of axially releasing the expansion element comprises actuating the axial actuator to move the second stop away from the first stop.

9. The method of claim 8, wherein the step of actuating the axial actuator comprises operating an electric motor of the casing expanding tool to drive a hydraulic pump of the casing expanding tool.

10. The method of claim 9, wherein the step of driving the hydraulic pump comprising hydraulically driving one or more pistons relative to an outer sleeve of the axial actuator, the one or more pistons operatively connected to the second stop and the outer sleeve operatively to the first stop.

11. A method of remediation of a well including a wellbore having a wellbore casing extending therethrough, the casing having a casing bore, the method comprising:

conveying a casing expanding tool downhole to at least one expansion location along the casing, wherein the at least one expansion location comprises at least one uphole expansion location uphole of a target interval, and at least one downhole expansion location downhole of the target interval, wherein one or more of the at least one expansion location is located at a portion of the casing having a cement sheath thereabout, the target interval including one or more leak paths formed in an annulus defined between the casing and the wellbore;

actuating the casing expanding tool to plastically deform the casing radially outward at the at least one expansion location, wherein plastically deforming the casing radially outward comprises compressing the cement sheath to compact the cement of the cement sheath at the at least one expansion location; and introducing sealant into the annulus via one or more perforations formed through the casing within the target interval.

12. The method of claim 11, wherein the step of actuating the casing expanding tool further comprises actuating an expansion element of the casing expanding tool radially outwards and radially contracting the expansion element after the casing has been plastically deformed.

13. The method of claim 11, wherein the sealant comprises cement.

14. A method of mitigating communication between a first subterranean formation and a second subterranean formation of a wellbore, the method comprising:

conveying a casing expanding tool downhole on a conveyance string to at least one expansion location along a wellbore casing located intermediate the first and second subterranean formations, the at least one expansion location being proximate to one or more leak paths in the annulus between the casing and the wellbore; and actuating the casing expanding tool to plastically deform the casing radially outward at the at least one expansion location, thereby restricting or blocking fluid flow through the one or more leak paths, wherein one or more of the at least one expansion location is located at a portion of the casing having a cement sheath thereabout, such that plastically deforming the casing radially outward further comprises compressing the cement sheath to compact the cement.

15. The method of claim 14, wherein the step of actuating the casing expanding tool further comprises actuating an expansion element of the casing expanding tool radially outwards and radially contracting the expansion element after the casing has been plastically deformed.

16. The method of claim 15, wherein the step of actuating the expansion element comprises axially compressing the expansion element to expand the expansion element radially outwards, and the step of radially contracting the expansion element comprises axially releasing the expansion element.

17. The method of claim 16, wherein the step of axially compressing the expansion element comprises actuating an axial actuator of the casing expanding tool to drive a second stop of the casing expanding tool toward a first stop of the casing expanding tool, and the step of axially releasing the expansion element comprises actuating the axial actuator to move the second stop away from the first stop.

18. The method of claim 17, wherein the step of actuating the axial actuator comprises operating an electric motor of the casing expanding tool to drive a hydraulic pump of the casing expanding tool.

19. The method of claim 18, wherein the step of driving the hydraulic pump comprising hydraulically driving one or more pistons relative to an outer sleeve of the axial actuator, the one or more pistons operatively connected to the second stop and the outer sleeve operatively to the first stop.

* * * * *